US007418763B2

(12) United States Patent
Shaver et al.

(10) Patent No.: US 7,418,763 B2
(45) Date of Patent: Sep. 2, 2008

(54) HAND VACUUM WITH FILTER INDICATOR

(75) Inventors: David M. Shaver, Brockville (CA); Jacob R. Prosper, Brockville (CA); Murray D. Hunter, Mallorytown (CA); Carolyn Martin, Baltimore, MD (US); Patrick W. Mooney, Brockville (CA); Olga Makeev, Mallorytown (CA)

(73) Assignee: Black & Decker Inc., Newark, DE (US)

( * ) Notice: Subject to any disclaimer, the term of this patent is extended or adjusted under 35 U.S.C. 154(b) by 736 days.

(21) Appl. No.: 10/787,059

(22) Filed: Feb. 25, 2004

(65) Prior Publication Data

US 2004/0216264 A1 Nov. 4, 2004

Related U.S. Application Data

(60) Provisional application No. 60/449,987, filed on Feb. 26, 2003.

(51) Int. Cl.
*A47L 5/14* (2006.01)

(52) U.S. Cl. ..... 15/330; 15/414; 15/415.1; 417/315; 417/423.2

(58) Field of Classification Search ..... None
See application file for complete search history.

(56) References Cited

U.S. PATENT DOCUMENTS

| | | | | |
|---|---|---|---|---|
| 1,302,929 | A | 5/1919 | Kirby | |
| 2,030,367 | A * | 2/1936 | Grave | 417/234 |
| 2,219,810 | A | 10/1940 | Foss | |
| 2,232,906 | A * | 2/1941 | Ernolf | 415/148 |
| 2,639,456 | A | 5/1953 | Smith | |
| 2,788,541 | A | 4/1957 | Kemnitz | |
| 2,806,242 | A | 9/1957 | Sparklin | |
| 3,172,743 | A | 3/1965 | Kowalewski | |
| 3,300,806 | A | 1/1967 | Ripple | |
| 3,557,399 | A | 1/1971 | Wolf | |
| 3,695,006 | A | 10/1972 | Valbona et al. | |
| 3,936,904 | A | 2/1976 | Bashark | |

(Continued)

FOREIGN PATENT DOCUMENTS

| | | |
|---|---|---|
| CA | 2 086 445 | 7/1994 |

(Continued)

OTHER PUBLICATIONS

Product Description of Metro Vac N' Blo Compact Car VNB-83BA□□http://www.govacuum.com/mevacnblcoca.html. 1997.*

*Primary Examiner*—David A Redding
(74) *Attorney, Agent, or Firm*—Harness, Dickey & Pierce, P.L.C.

(57) ABSTRACT

A hand-held portable vacuum having a filter indicator that is coupled to an outlet housing and in fluid communication with a portion of the outlet housing between a fan inlet and an intake. The filter indicator includes a pressure differential indicator that is configured to indicate a pressure differential between air in the portion of the outlet housing and atmospheric air pressure. The filter indicator is employed to indicate to the user of the hand-held vacuum that replacement and/or cleaning of the filter is required. The vacuum may also be used in a blower mode with a set of inflator nozzles to permit a user to inflate an article.

14 Claims, 18 Drawing Sheets

U.S. PATENT DOCUMENTS

| | | | | |
|---|---|---|---|---|
| 4,059,293 | A | | 11/1977 | Sipler |
| 4,070,170 | A | | 1/1978 | Leinfelt |
| 4,100,878 | A | | 7/1978 | Leinfelt |
| 4,114,230 | A | | 9/1978 | MacFarland |
| 4,199,838 | A | | 4/1980 | Simonsson |
| 4,330,900 | A | | 5/1982 | Dorr et al. |
| 4,405,158 | A | * | 9/1983 | Huberman ..... 289/7 |
| 4,416,033 | A | | 11/1983 | Specht |
| 4,419,782 | A | | 12/1983 | Sobczyk et al. |
| 4,481,692 | A | | 11/1984 | Kurz |
| 4,642,841 | A | | 2/1987 | Berfield et al. |
| 4,656,687 | A | | 4/1987 | Wei |
| 4,660,246 | A | | 4/1987 | Duncan |
| 4,685,171 | A | | 8/1987 | Beaudoin |
| 4,767,213 | A | | 8/1988 | Hummel |
| 4,800,614 | A | | 1/1989 | Kopco et al. |
| 4,829,625 | A | * | 5/1989 | Wang ..... 15/422.2 |
| 4,850,076 | A | | 7/1989 | Ostroski et al. |
| 4,947,512 | A | | 8/1990 | Lackner et al. |
| 4,993,108 | A | | 2/1991 | Genge et al. |
| 5,023,973 | A | | 6/1991 | Tsuchida et al. |
| 5,050,266 | A | * | 9/1991 | Schneider ..... 15/421 |
| 5,060,339 | A | | 10/1991 | Evers |
| 5,086,536 | A | | 2/1992 | Lackner et al. |
| 5,129,128 | A | | 7/1992 | Bowerman et al. |
| 5,289,610 | A | | 3/1994 | Monson |
| 5,329,666 | A | | 7/1994 | Bowerman et al. |
| 5,331,716 | A | | 7/1994 | Hemmann et al. |
| 5,355,549 | A | | 10/1994 | Steinberg et al. |
| 5,392,490 | A | | 2/1995 | Monson |
| 5,500,978 | A | | 3/1996 | Levine |
| 5,561,885 | A | | 10/1996 | Zahuranec et al. |
| 5,586,358 | A | | 12/1996 | Wolfe et al. |
| 5,608,944 | A | | 3/1997 | Gordon |
| 5,829,093 | A | | 11/1998 | Kim |
| 6,029,309 | A | | 2/2000 | Imamura |
| 6,125,501 | A | | 10/2000 | Yip |
| 6,434,785 | B1 | | 8/2002 | Vandenbelt et al. |

FOREIGN PATENT DOCUMENTS

| | | |
|---|---|---|
| CA | 2 254 188 | 5/2000 |
| DE | 1 949 328 | 11/1966 |
| DE | 8417091 | 9/1984 |
| DE | 39 41 039 | 12/1989 |
| DE | 41 35 406 | 5/1992 |
| DE | EP 0 893 962 | 2/1999 |
| DE | 197 36 596 | 6/2001 |
| EP | 0 430 146 | 6/1991 |
| EP | 1 070 478 | 1/2001 |
| EP | 1 222 891 | 7/2002 |
| EP | 1 252 854 | 10/2002 |
| GB | 1 379 162 | 1/1975 |
| GB | 1 455 926 | 11/1976 |
| GB | 2 154 862 | 9/1985 |
| GB | 2 234 029 | 1/1991 |

* cited by examiner 10a
406

10a
408

10a
420
402
450
408

10a
420
404

10a
420
400
430
406

10a
420
400
404

10a
420
400
430
408

HAND VACUUM WITH FILTER INDICATOR

CROSS-REFERENCE TO RELATED APPLICATIONS

This application claims the benefit of U.S. Provisional Application No. 60/449,987, filed Feb. 26, 2003.

FIELD OF THE INVENTION

The present invention generally relates to hand-held portable vacuum cleaners and more particularly to a hand-held portable vacuum cleaner having a filter indicator.

BACKGROUND OF THE INVENTION

Bag-less, portable hand-held vacuums of the corded and cordless varieties are well known in the art and typically include a fan for producing an air flow, a dirt cup for retention of the material, such as dirt, dust and debris, that is drawn into the vacuum and a filter that prevents this material from being drawn into the fan. The filter may include a single filter media, which may be a fabric or paper material, or may utilize several materials that are arranged in series so as to progressively filter the air flow.

As is well known in the art, the users of such bag-less portable hand-held vacuums tend to be less than diligent in the maintenance of such vacuums so that such vacuums are frequently operated with clogged and/or dirty filters. Operation of a bag-less hand-held vacuum in this manner impairs the performance of the vacuum, increases the load on the fan motor and fan (which tends to reduce the life of these components), and in the case of cordless vacuums, tends to reduce both the life of its rechargeable battery and the duration with which the vacuum may be operated on a single charge.

In view of the tendency of consumers to operate such vacuums with clogged or dirty filters, the industry has focused on improved filter configurations that utilize several filtering stages that commence with a relatively coarse plastic or wire screen and terminate in a relatively fine fabric or paper material that is configured to prevent relatively small sized particles from entering the fan. We have found that although the advancements in filter technology for such vacuums have generally increased the time interval that is permissible between filter cleanings, these advancements have thus far not eliminated the necessity of such cleanings.

SUMMARY OF THE INVENTION

In one form, the teachings of the present invention provides a hand-held portable vacuum having an inlet housing, an outlet housing, a fan assembly and a filter indicator. The inlet housing defines an inlet that is configured to receive therethrough dirt, dust and debris. The outlet housing is releasably coupled to the inlet housing and defines a handle, an intake, a fan mount and an outlet. The handle is configured to be grasped by a single hand of a user to permit the user to maneuver the hand-held portable vacuum and orient the inlet into a desired position. The fan mount is disposed between the intake and the outlet. The fan assembly is mounted in the fan mount and housed by the outlet housing. The fan assembly includes a fan inlet and is operable for generating an air flow therethrough. The filter is disposed between the inlet and the intake and is releasably coupled to one of the inlet housing and the outlet housing. The filter indicator is coupled to the outlet housing and in fluid communication with a portion of the outlet housing between the fan inlet and the intake. The filter indicator includes a pressure differential indicator that is configured to indicate a pressure differential between air in the portion of the outlet housing and atmospheric air pressure.

In another form, the teachings of the present invention provide a portable vacuum having an inlet housing, an outlet housing, a fan assembly, a hose and a set of inflator nozzles. The inlet housing defines an inlet that is configured to receive dirt, dust and debris therethrough. The outlet housing may be releasably coupled to the inlet housing and may define a handle, an intake, and an exhaust outlet. The fan assembly is mounted in the outlet housing and is operable for generating an air flow that is exhausted through the exhaust outlet. The hose has a first end, which may be selectively coupled to the exhaust outlet, and a second end. Each of the inflator nozzles includes a coupling portion, which is configured to selectively engage the second end of the hose, a tapered male connector that defines an outlet aperture, and a relief aperture that extends through a wall of the inflator nozzle into a generally hollow interior. The tapered male connector of each inflator nozzle is differently sized.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
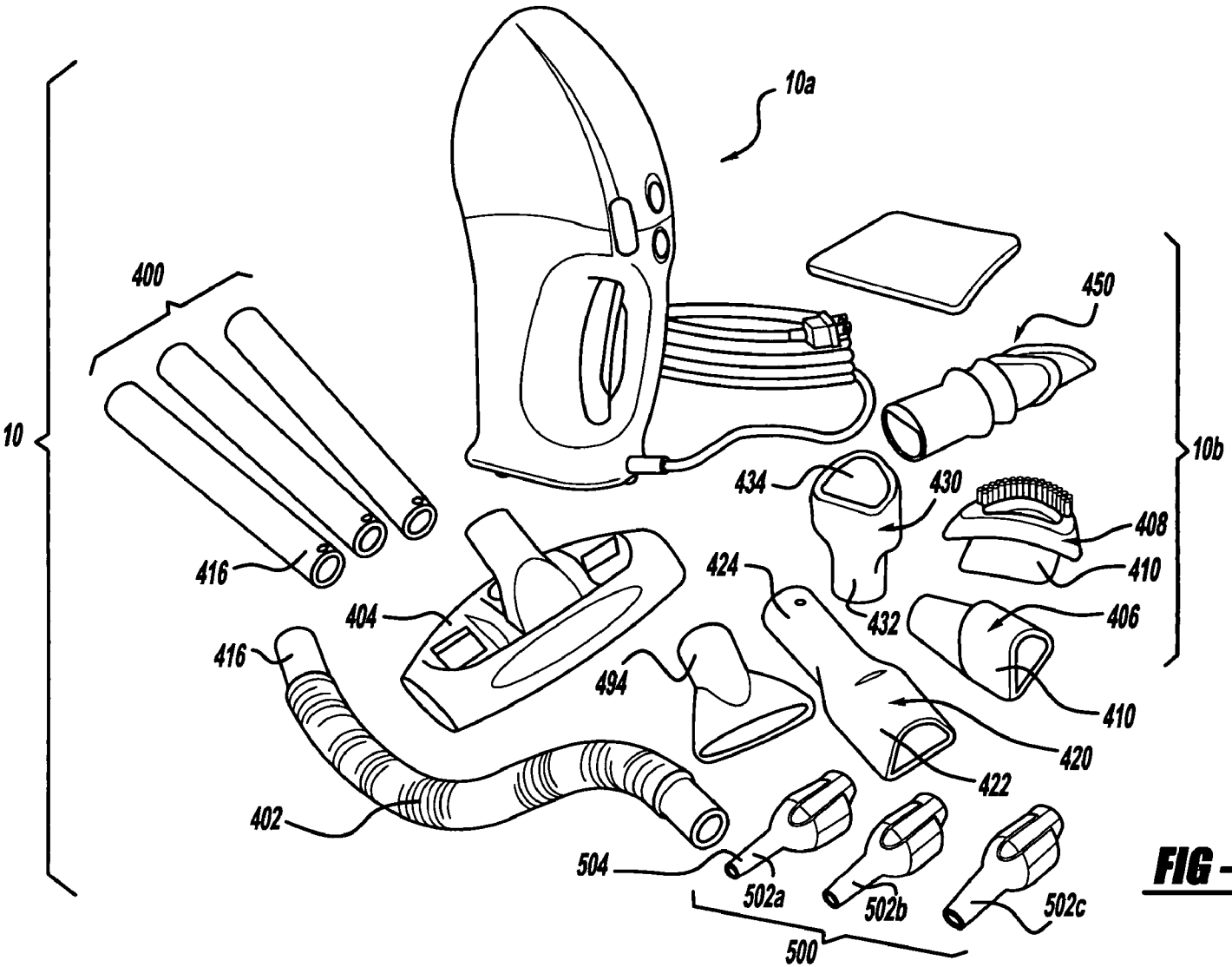
FIG. 1 is an exploded perspective view of a vacuum kit constructed in accordance with the teachings of the present invention.
Figure 2:
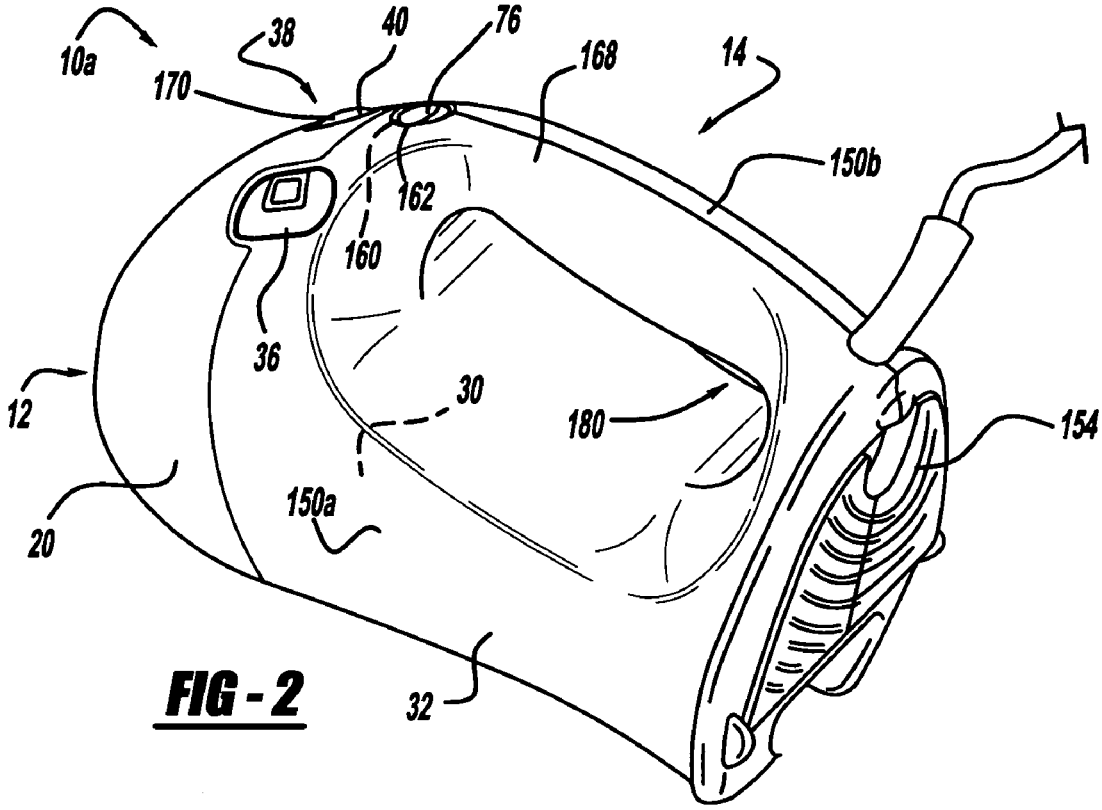
FIG. 2 is a perspective view of a portion of the vacuum kit of FIG. 1 illustrating the vacuum in greater detail.
Figure 3:
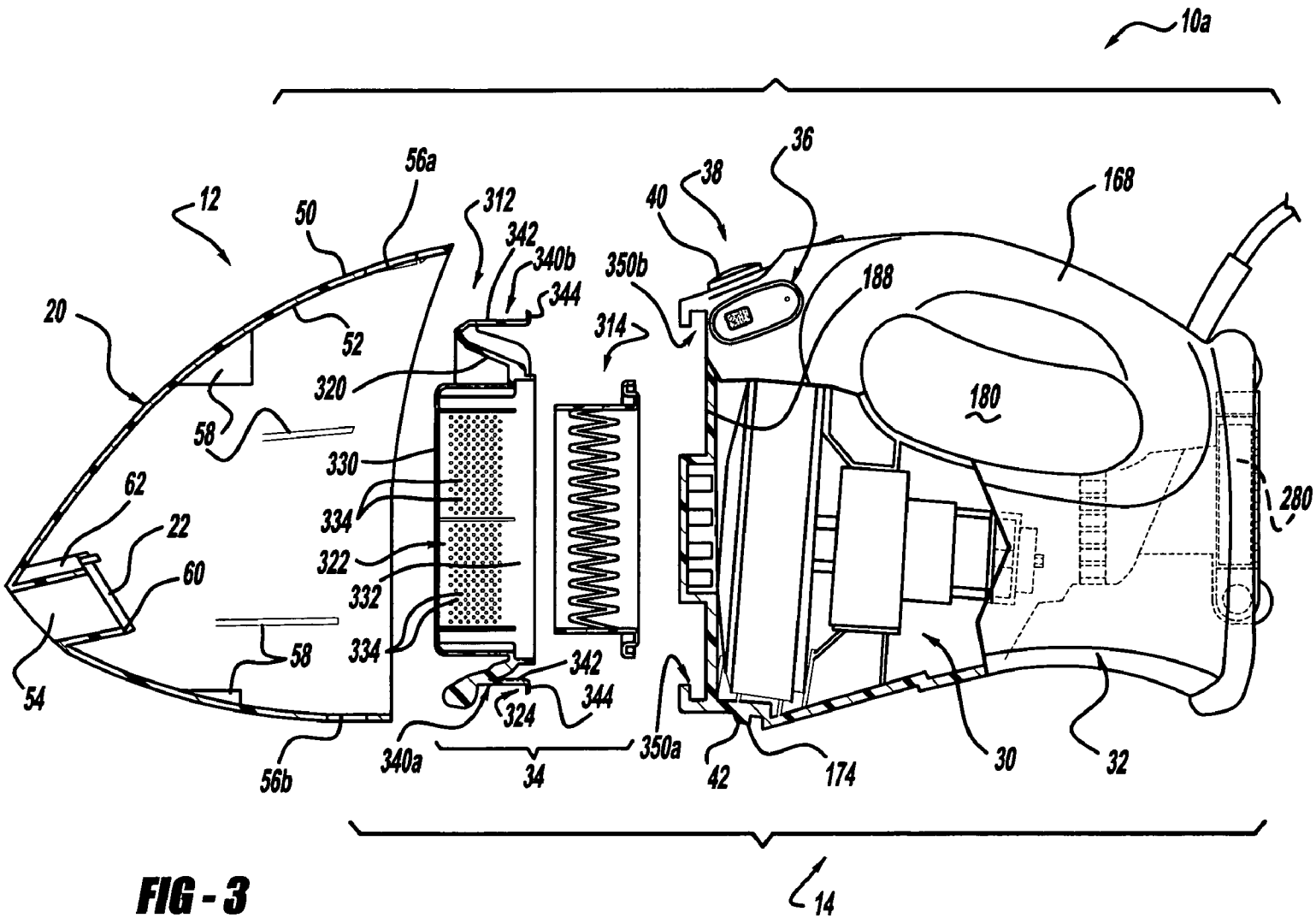
FIG. 3 is a partially sectioned, partially exploded view of the vacuum of FIG. 2.

With reference to FIG. 1 of the drawings, a vacuum kit constructed in accordance with the teachings of the present invention is generally indicated by reference numeral 10. The vacuum kit 10 is illustrated to include a hand-held corded vacuum 10*a* and a set of accessories 10*b*. With reference to FIGS. 2 and 3, the vacuum 10*a* is illustrated to include a dirt cup assembly 12 and a housing assembly 14. In the particular example provided, the dirt cup assembly 12 includes an inlet housing or dirt cup 20 and a resilient closure member 22, while the housing assembly 14 includes motor assembly 30, an outlet housing or housing 32, a filter system 34, a filter indicator 36 and a latch release 38 having a conventional latch mechanism 40 and a conventional retaining tab 42 that is integrally formed with the housing 32.

The dirt cup 20 includes a wall member 50 that defines a container-like housing structure 52 and an inlet port 54 that is formed through the housing structure 52 and which extends rearwardly therefrom. A pair of securing apertures 56*a* and 56*b* are formed through the housing structure 52 and a plurality of prefilter locating tabs 58 extend inwardly from the wall member 50 about the inside perimeter of the housing structure 52. Both the securing apertures 56*a* and 56*b* and the prefilter locating tabs 58 will be discussed in additional detail, below.

In the particular example provided, the inlet port 54 is semi-circular in shape (see, e.g., FIG. 19), extending rearwardly from the housing structure 52 and terminating at a rearwardly and downwardly tapered face 60 (i.e., the bottom of the inlet port 54 extends further rearwardly than the top of the inlet port 54). As will be discussed in greater detail, below, the inlet port 54 is configured to frictionally engage various components of the accessory set 10*b*.

A mounting boss 62, which is coupled to the housing structure 52 above the inlet port 54, serves as the location at which the resilient closure member 22 is hingedly coupled to the housing structure 52. The resilient closure member 22 is configured to abut the rearwardly and downwardly tapered face 60 of the inlet port 54 but deflect upwardly (away from the rearwardly and downwardly tapered face 60) during the operation of the vacuum 10*a*. As those skilled in the art will appreciate, the resilient closure member 22 may be omitted through techniques that are well known in the art, as through extending the inlet port 54 rearwardly and upwardly toward the upper rear of the housing structure 52.

Figures 4, 5:
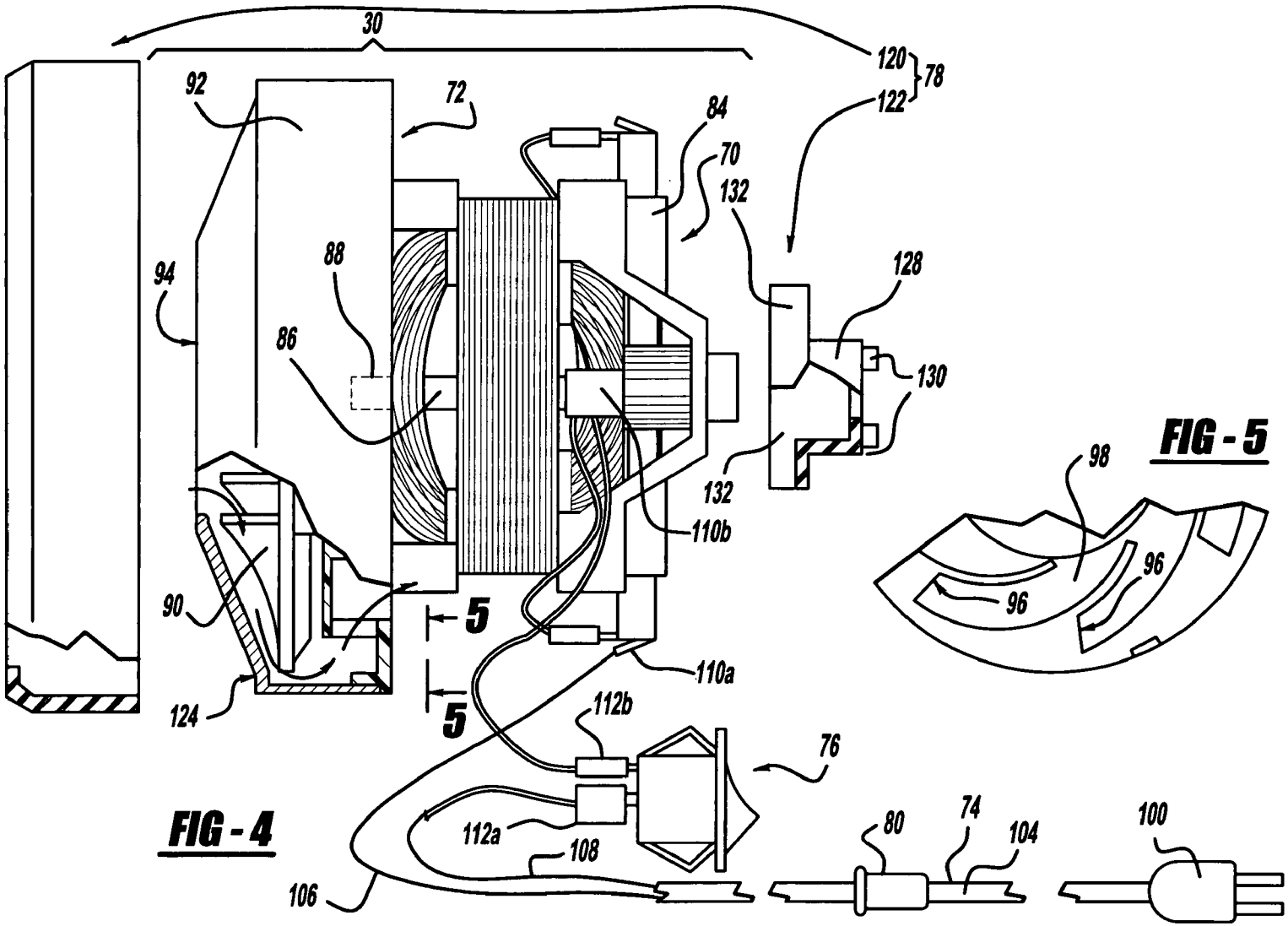
FIG. 4 is an exploded side view in partial section of a portion of the vacuum of FIG. 2 illustrating the motor assembly in greater detail.
FIG. 5 is a partial rear view of the motor assembly illustrating the discharge side of the fan housing in greater detail.
Figure 6:
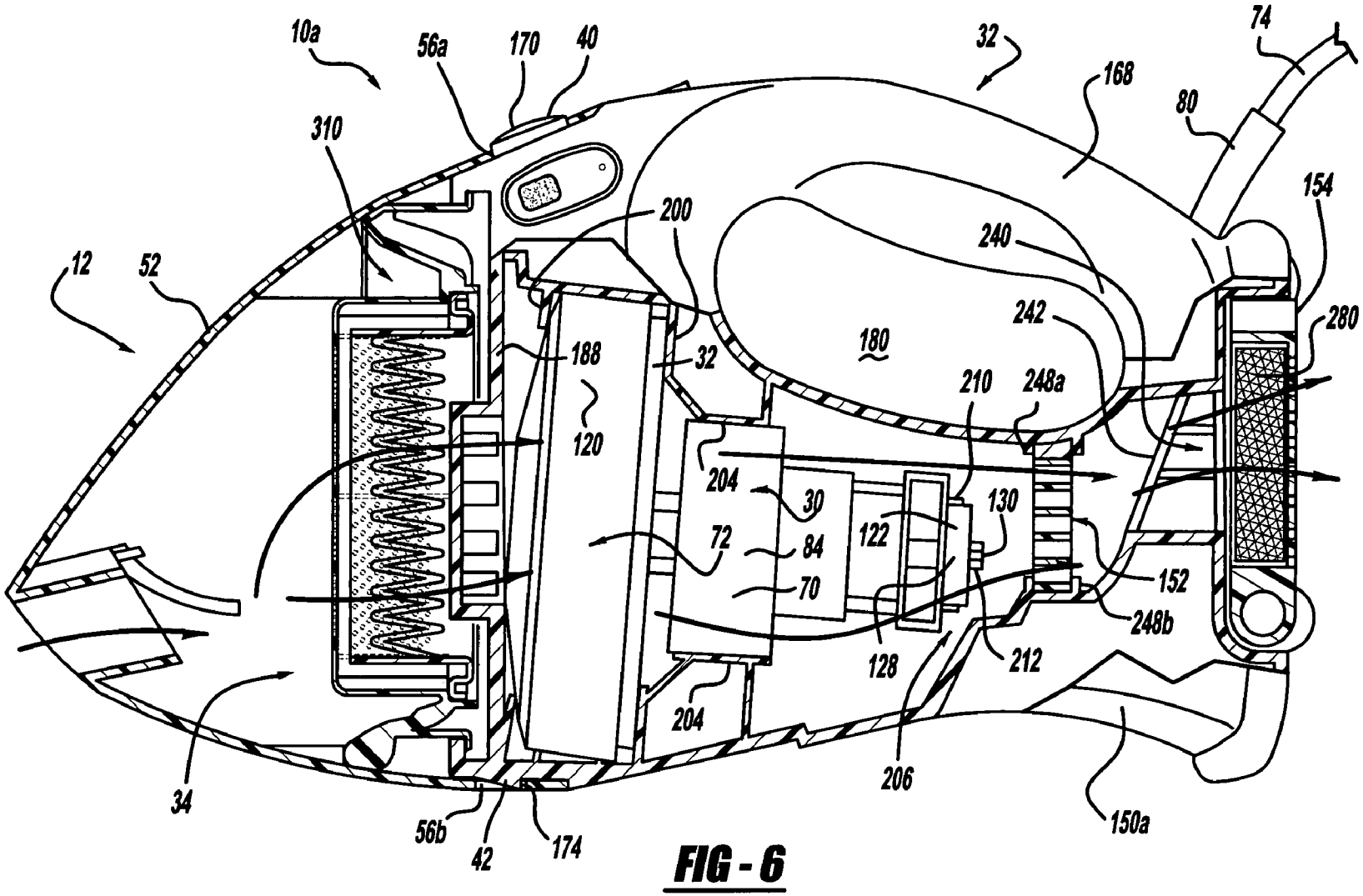
FIG. 6 is a partially sectioned side view of the vacuum of FIG. 2.

In FIGS. 4 through 6, the motor assembly 30 is illustrated to include a motor 70, a fan assembly 72, a power cord 74, a power switch 76, a set of isolators 78 and a strain relief 80. The motor 70 is a conventional AC motor having a stator body 84 and a rotor 86 that includes a motor output shaft 88. The fan assembly 72 is a conventional centrifugal fan that includes an impeller 90, which is coupled for rotation with the output shaft 88, and a fan housing 92. The fan housing 92 includes an inlet aperture 94 that is centered about the rotational axis of the impeller 90, and a plurality of discharge apertures 96, which are located on a side of the fan housing 92 opposite the inlet aperture 94 and radially outwardly therefrom. Air that is discharged from each discharge aperture 96 is guided through an associated flow channel 98 where the air is directed radially inwardly toward the rotational axis of the rotor 86 for cooling of the motor 70 when the vacuum 10*a* is operating.

The power cord 74 conventionally includes a connector plug 100, which is adapted to be connected to an electrical outlet, and a cord member 104 having first and second conductors 106 and 108, which are electrically coupled to the connector plug 100 in a conventional and well known manner. The first conductor 106 is electrically coupled to a first terminal 110*a* on the motor 70, while the second conductor 108 is electrically coupled to a first terminal 112*a* on the power switch 76. The power switch 76 is a conventional toggle switch that selectively enables or disables the transmission of electric power across its first and second terminals 112*a* and 112*b*, respectively. The second terminal 112*b* of the power switch 76 is electrically coupled to the second terminal 110*b* on the motor 70. The strain relief 80 is coupled to the power cord 74 to strengthen the portion of the power cord 74 that enters into the housing 32, as well as to seal the housing 32 so that air traveling through the vacuum 10*a* is not discharged through the aperture through which the cord member 104 extends. The strain relief 80 is illustrated as being fixedly coupled or formed with the insulative cover of the cord member 104, but those skilled in the art will appreciate that the strain relief 80 may be a discrete component that has been slid over the cord member 104.

The set of isolators 78 includes a fan isolator 120 and a motor isolator 122, both of which are formed from a suitable resilient material, such as rubber or a thermoplastic elastomer. In the embodiment illustrated, the fan isolator 120 is an annular band that wraps around the outer perimeter of a forward portion of the fan housing 92 as well as the radially outermost portion of its front face 124. The fan isolator 120 engages the fan housing 92 in a conventional friction-fit manner. Furthermore, contact between the fan isolator 120 and the front face 124 of the fan housing 92 limits rearward movement of the fan isolator 120.

The motor isolator 122 includes a hub portion 128 and a locating element, the latter of which is illustrated to include a pair of tabs 130 that are formed onto the rear surface of the hub portion 128. The hub portion 128 is configured to frictionally engage the end of the motor 70 opposite the fan assembly 72; a pair of legs 132 that extend generally parallel to the centerline of the hub portion 128 are configured to engage the stator body 84 such that the tabs 130 are positioned in a predetermined location as will be described in greater detail, below.

Figure 7:
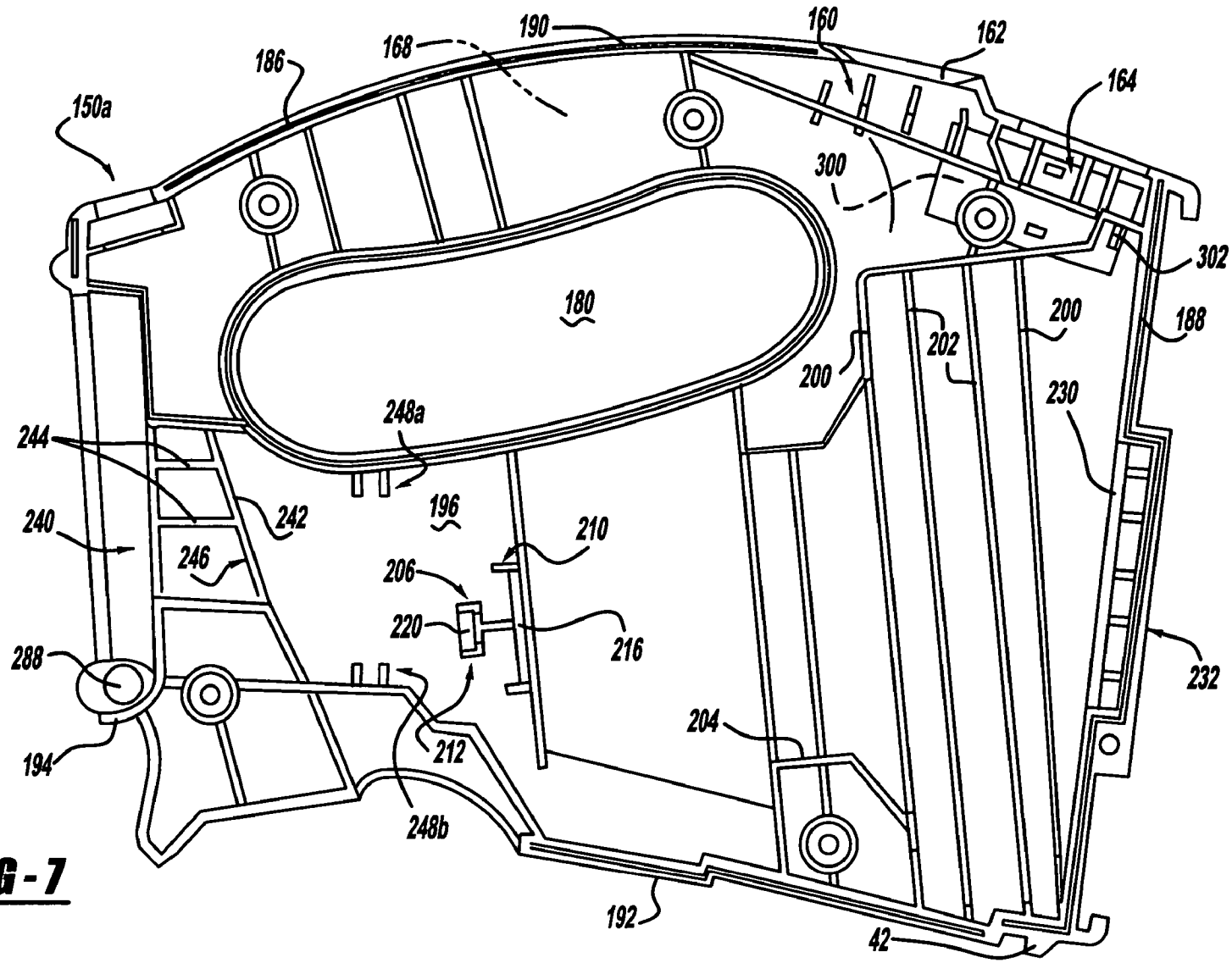
FIG. 7 is a side view of a portion of the vacuum of FIG. 2, illustrating a housing shell in greater detail.

With reference to FIGS. 2, 6 and 7, the housing 32 of the particular embodiment provided includes a pair of housing shells 150*a* and 150*b*, an internal baffle 152 and rear deflector 154. The housing shells 150*a* and 150*b* are configured to be coupled together in a conventional and well known manner to define a switch mounting structure 160, a switch aperture 162, a latch mounting structure 164, the retaining tab 42 and a handle 168. The switch mounting structure 160 is conventionally configured to receive therein and support the power switch 76 of the motor assembly 30 such that the power switch 76 extends through the switch aperture 162 so as to be actuate-able by the user of the vacuum 10*a*.

The latch mounting structure 164 is configured to receive therein and support a conventional latch mechanism 40 having a push button 170 for engaging the securing aperture 56*a* in the housing structure 52 of the dirt cup assembly 12 and a spring (not shown) for biasing the push button 170 outwardly from the housing 32.

The retaining tab 42 extends outwardly from the housing 32 and defines an abutting wall 174. The retaining tab 42 is configured to project through the securing aperture 56*b* when the dirt cup assembly 12 is coupled to the housing assembly 14 to permit the abutting wall 174 to cooperate with the rear edge of the securing aperture 56*b* to thereby limit forward movement of the dirt cup assembly 12 relative to the housing assembly 14.

In the example provided, the handle 168 is integrally formed with the housing shells 150*a* and 150*b*, extending between the forward and rearward portions of the housing 32 and above the body of the housing 32 to define therebetween a handle aperture 180 that is sized to receive the hand of the user of the vacuum 10*a*. Those skilled in the art will appreciate, however, that the handle 168 may be a discrete component that is joined or fastened to the remainder of the housing 32 in a known manner. For reasons that will be apparent from the description below, the handle 168 is preferably configured so as to be comfortably gripped by the user of the vacuum 10*a*, regardless of whether the vacuum 10*a* is facing forwardly or rearwardly in the hand of the user.

Except as noted below, each of the housing shells 150*a* and 150*b* is constructed in an identical manner so that further description of the housing shell 150*a* will suffice for both. With primary reference to FIG. 7 and additional reference to FIG. 6, the housing shell 150*a* includes a wall member 186 that defines a front wall 188, a side wall 190, a bottom wall 192 and a rear wall 194, all of which cooperate to create a central cavity 196.

A plurality of ribs extend into the central cavity 196 from the side wall 190 and include first and second fan ribs 200 and 202, respectively, and first and second motor ribs 204 and 206, respectively. The first and second fan ribs 200 and 202 are semi-circular in shape, with the first fan ribs 200 extending radially inwardly relatively farther than the second fan ribs 202. The first fan ribs 200 are spaced apart to receive therebetween the fan housing 92 and the fan isolator 120. As such, the first fan ribs 200 serve to locate the fan assembly 72 relative to the front wall 188. In contrast, the second fan ribs 202, which are disposed between the first fan ribs 200, serve to locate the fan assembly 72 relative to a predetermined axis (e.g., the lateral centerline) of the vacuum 10*a*.

The first motor ribs 204 are interconnected to one another to strengthen the area at which they contact the stator body 84 of the motor assembly 30. The first motor ribs 204 are similar to the second fan ribs 202 in that they are configured to locate the motor assembly 30 relative to the predetermined axis of the vacuum 10*a*. Additionally, the first motor ribs 204 engage the stator body 84 so as to inhibit rotation of the stator body 84 relative to the housing shell 150*a*.

The second motor rib 206 includes a hub mounting portion 210 and a hub locating portion 212 that is interconnected to but spaced somewhat rearwardly of the hub mounting portion 210. The hub mounting portion 210 terminates at the end opposite the side wall 190 in an arcuate surface 216, which is configured to abut against the cylindrical part of the hub portion 128 of the motor isolator 122, while the hub locating portion 212 terminates at a bifurcated end that defines a tab aperture 220 which is sized to receive an associated one of the tabs 130 of the motor isolator 122. The hub mounting portion 210 and the hub locating portion 212 further abut various rear surfaces of the hub portion 128. Accordingly, both the hub mounting portion 210 and the hub locating portion 212 limit rearward movement of the motor isolator 122 (and therefore the motor 70 as well).

In the example provided, the front wall 188 is generally planar, except for a semi-circular intake port 230 that extends forwardly from therefrom. The intake port 230 includes a lattice structure 232 through which air is drawn. The lattice structure 232 serves to limit access to the rotating fan blades.

Figure 23:
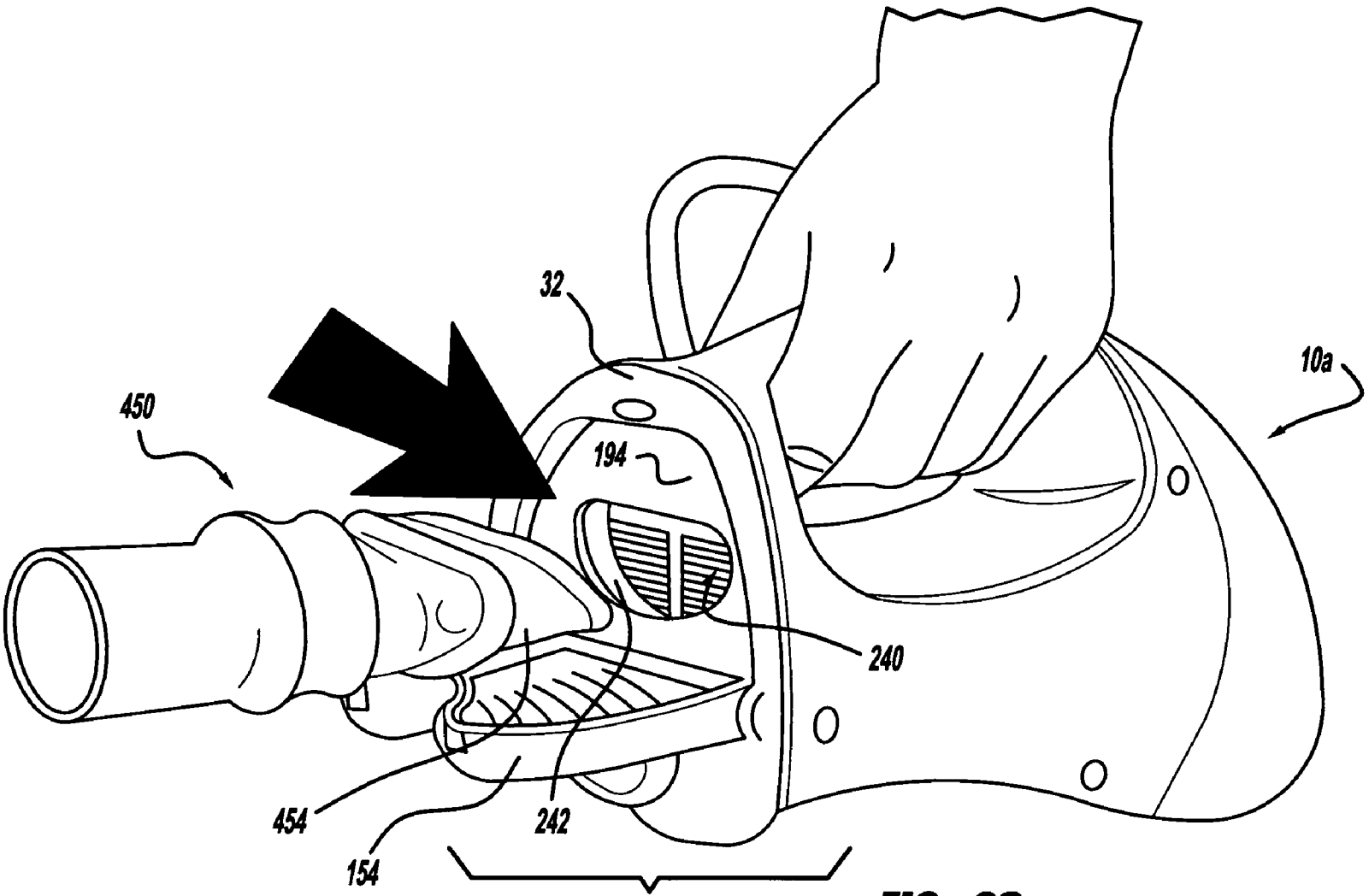
FIG. 23 is an exploded perspective view of the vacuum kit of FIG. 1 illustrating the use of the adapter for directing the discharge of the vacuum.

The rear wall 194 is also generally planar, but in the particular embodiment illustrated includes a quarter circle-shaped outlet port 240 (when the housing shells 150*a* and 150*b* are assembled to one another, the outlet port 240 of the vacuum 10*a* is half-moon or semi-circular in shape as illustrated in FIG. 23). A gusset 242 and a plurality of reinforcements 244, which interconnect the gusset 242 and the rear wall 194, serve to strengthen the rear wall 194, particularly in the area of the outlet port 240. A flow aperture 246 is formed through the gusset 242, which in the example provided, has a shape and size that approximately mimics the shape and size of the outlet port 240.

A set of baffle ribs 248*a*, 248*b* are located somewhat rearwardly of the second motor rib 206 and forwardly of the gusset 242. The set of baffle ribs 248*a* includes a first pair of ribs, which extend downwardly from the portion of the side wall 190 below the handle aperture 180, and the set of baffle ribs 248*b* include a second pair of ribs, which extend upwardly from the bottom wall 192. The set of baffle ribs 248*a*, 248*b* are configured so as to frictionally engage the opposite faces of the internal baffle 152 to thereby maintain the location of the internal baffle 152 at a desired location between the second motor rib 206 and the gusset 242.

Figure 8:
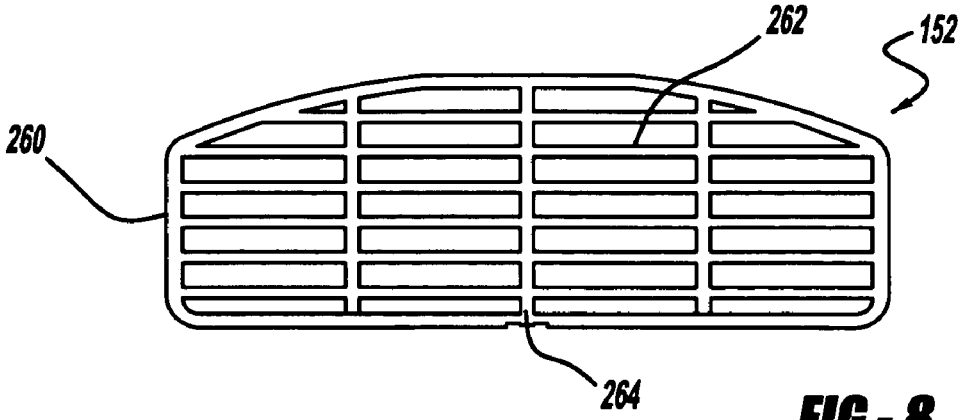
FIG. 8 is a front view of a portion of the vacuum of FIG. 2, illustrating the internal baffle in greater detail.

With additional reference to FIG. 8, the internal baffle 152 of the particular example provided includes a frame 260 that is configured to generally conform to the central cavity 196 at the location of the set of baffle ribs 248*a*, 248*b*. A plurality of generally horizontally arranged flow guiding vanes 262 and a generally vertically arranged strengthening members 264 are set into the frame 260 and fixedly coupled thereto. The internal baffle 152, in general, and the flow guiding vanes 262, in particular, are employed to prevent direct access to the live motor parts.

Figure 9:
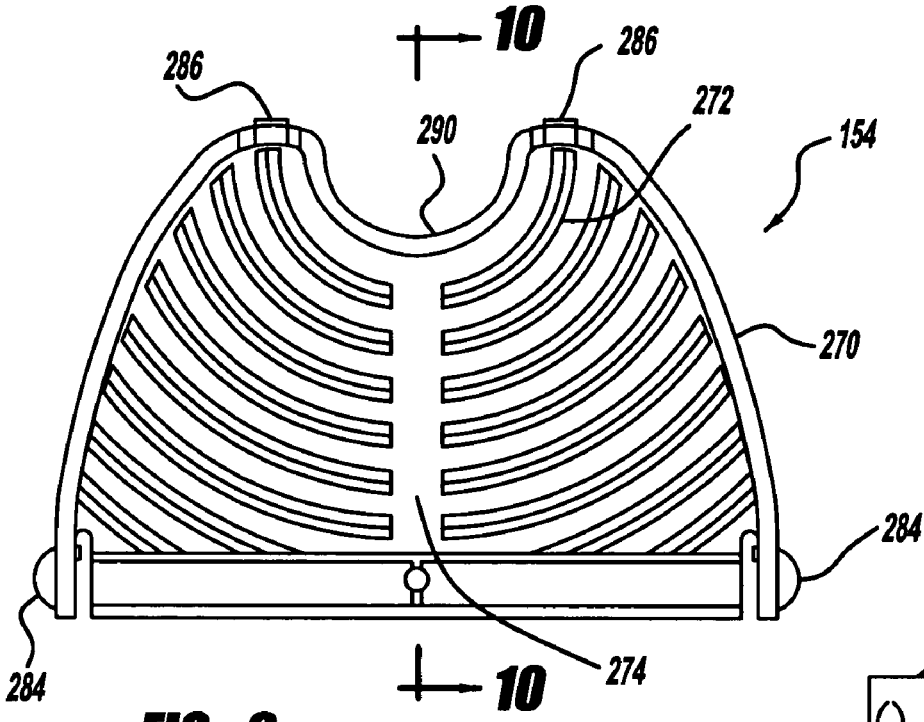
FIG. 9 is a rear view of a portion of the vacuum of FIG. 2, illustrating the rear deflector in greater detail.
Figure 10:
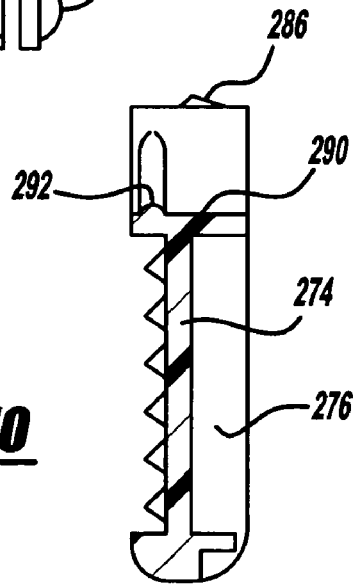
FIG. 10 is a sectional view taken along the line 10-10 of FIG. 9.
Figure 11:
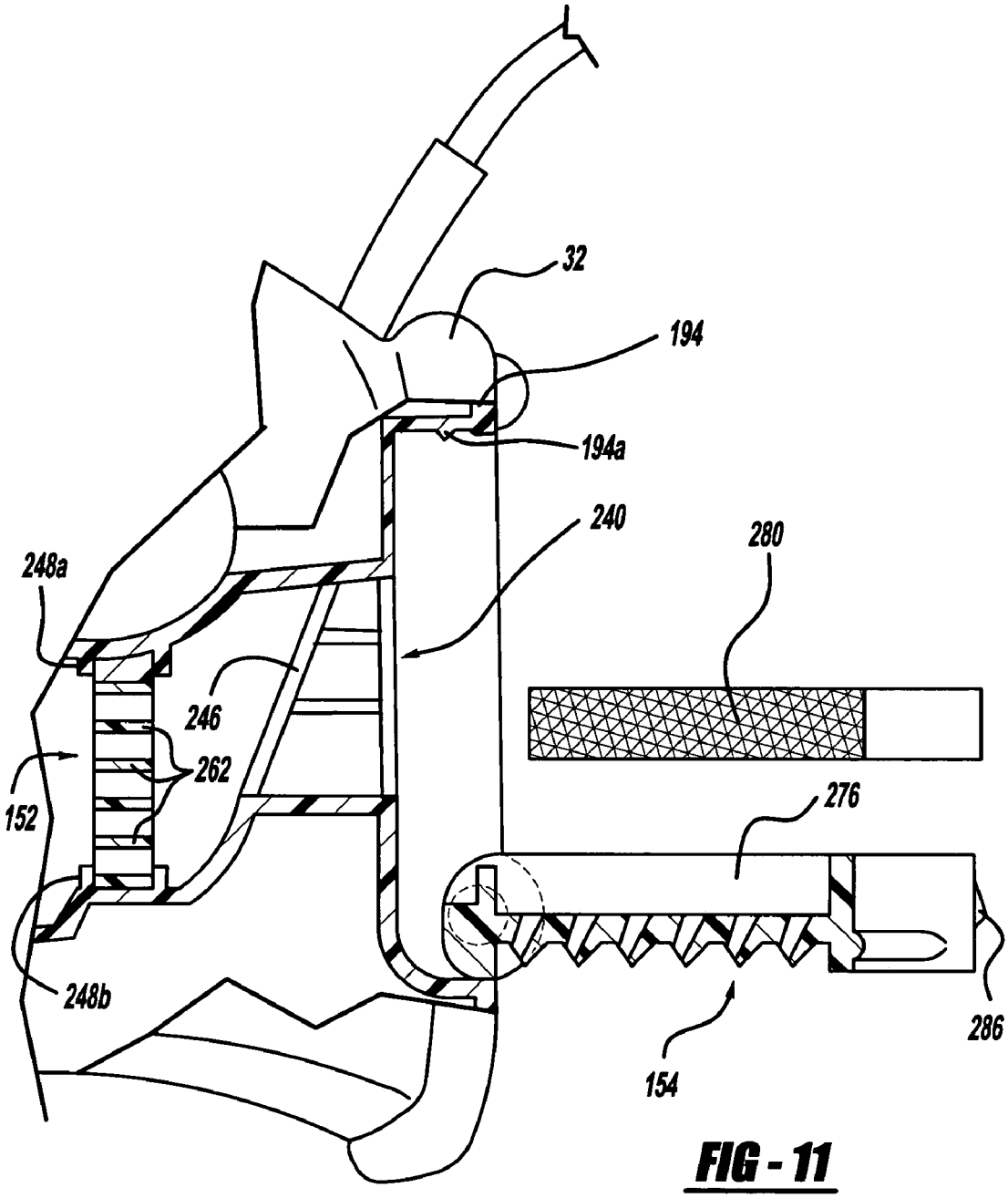
FIG. 11 is a partially exploded, partially sectioned side view of a portion of the vacuum of FIG. 2.

With specific reference to FIGS. 9 through 11, and additional reference to FIGS. 6 and 7, the rear deflector 154 also includes a frame 270, a plurality of flow guiding vanes 272 and a generally vertically arranged strengthening member 274 that are set into the frame 270 and fixedly coupled thereto. The flow guiding vanes 272 of the particular embodiment illustrated are arcuately shaped so as to direct the air exiting the outlet port 240 both rearwardly and radially outwardly from the outlet port 240.

Unlike the frame 260 of the internal baffle 152, the frame 270 of the rear deflector 154 extends forwardly of the flow guiding vanes 272 to create a pocket 276 into which may be fitted an optional porous exhaust filter 280. The exhaust filter 280 operates to filter the air that exits the outlet port 240 and thereby prevents fine dust particles from being expelled from the vacuum 10*a* when the vacuum 10*a* is being used in a vacuuming mode. The exhaust filter 280 is formed from a non-woven mesh fabric in the particular embodiment provided and is thus washable should it become undesirably dirty or clogged. Those skilled in the art will appreciate, however, that the exhaust filter 280 may be formed from another washable filter media or may alternately be a disposable type filter (e.g., paper).

The frame 270 also includes a pair of trunnions 284 and a pair of clip structures 286. The trunnions 284 permit the rear deflector 154 to be pivotably coupled to the housing 32. More specifically, each of the housing shells 150*a* and 150*b* includes a recess 288 that is spherically shaped in the particular embodiment provided to receive an associated one of the trunnions 284. Each trunnion 284 is illustrated as being coupled to a portion of the frame 270 that may be deflected laterally inward (i.e., toward the centerline of the rear deflector 154) so that the trunnions 270 may be installed to their respective recess 284 when the housing shells 150*a* and 150*b* are coupled to one another. With the trunnions 284 engaged to recesses 288, the rear deflector 154 may be pivoted between a closed position (illustrated in FIGS. 2 and 6), wherein the rear surface of the rear deflector 154 covers the outlet port 240, and an open position (illustrated in FIG. 11), wherein the rear deflector 154 substantially clears the outlet port 240.

The clip structures 286 are configured to resiliently deflect in response to the application of a modest force to the rear deflector 154 to permit the rear deflector 154 to be secured to or released from the rear wall 194 when the rear deflector 154 is moved into or out of the closed position. As will be apparent to those of ordinary skill in the art, engagement of the clip structures 286 to the rear wall 194 effectively maintains the rear deflector 154 in the closed position. Those skilled in the art will also appreciate that features such as recesses or tabs 194*a* may be formed into the rear wall 194 of the housing 32 to serve as points that enhance or improve the ability of the clip structures 286 to engage the rear wall 194.

Returning to FIGS. 9 and 10 of the example provided, the top of the frame 270 of the rear deflector 154 is illustrated as being arcuately shaped to define a finger grip 290 that is configured to receive the thumb or finger of the user of the vacuum 10*a* so that the thumb or finger may be employed to move the rear deflector 154 out of the closed position. The finger grip 290 preferably includes a gripping feature, such as a raised lip 292, that permits the user to pry downwardly and outwardly on the rear deflector 154 with their thumb or finger to thereby disengage the clip structures 286 from the rear wall 194.

Figure 12:
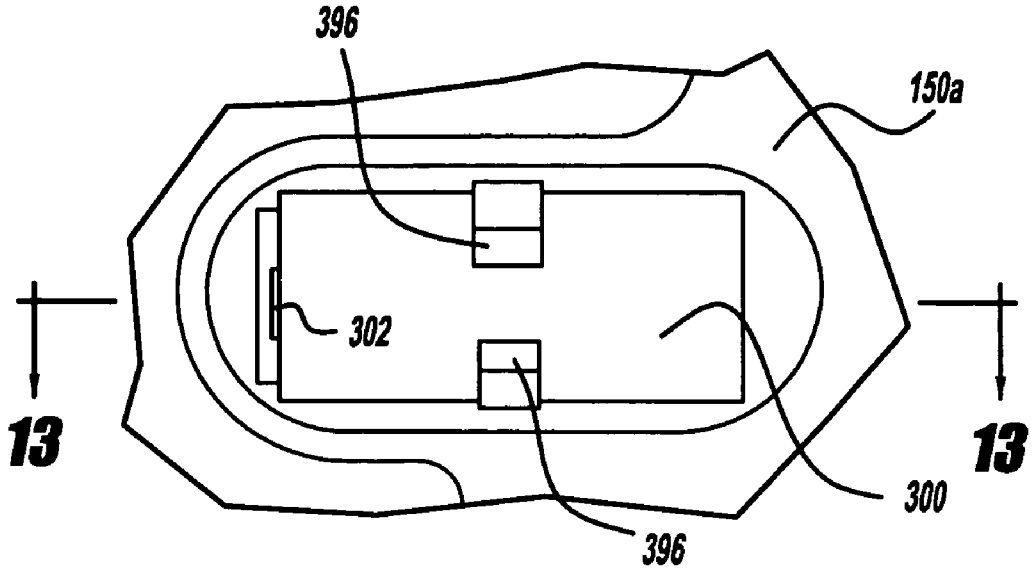
FIG. 12 is a side view of a portion of the vacuum of FIG. 2 illustrating the exterior of a portion of a housing shell in the vicinity of the indicator recess.
Figure 13:
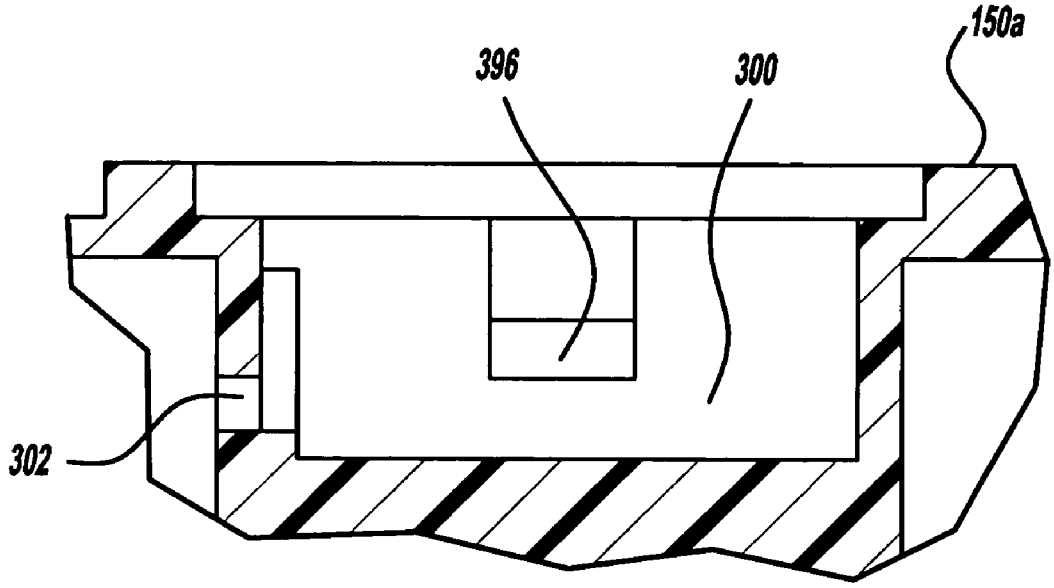
FIG. 13 is a section view taken along the line 13-13 of FIG. 12.

As noted above, the housing shell 150*a* differs somewhat from the housing shell 150*b*. More specifically, as shown in FIGS. 7, 12 and 13, the housing shell 150*a* includes a indicator recess 300 that is configured to receive the filter indicator 36 (FIG. 2). The indicator recess 300 includes a flow aperture 302 that is located between the front wall 188 and the forward most first fan rib 200 and which extends through the housing shell 150*a* to form a flow path between the indicator recess 300 and the portion of the central cavity 196 forward of the first fan ribs 200.

Figure 14:
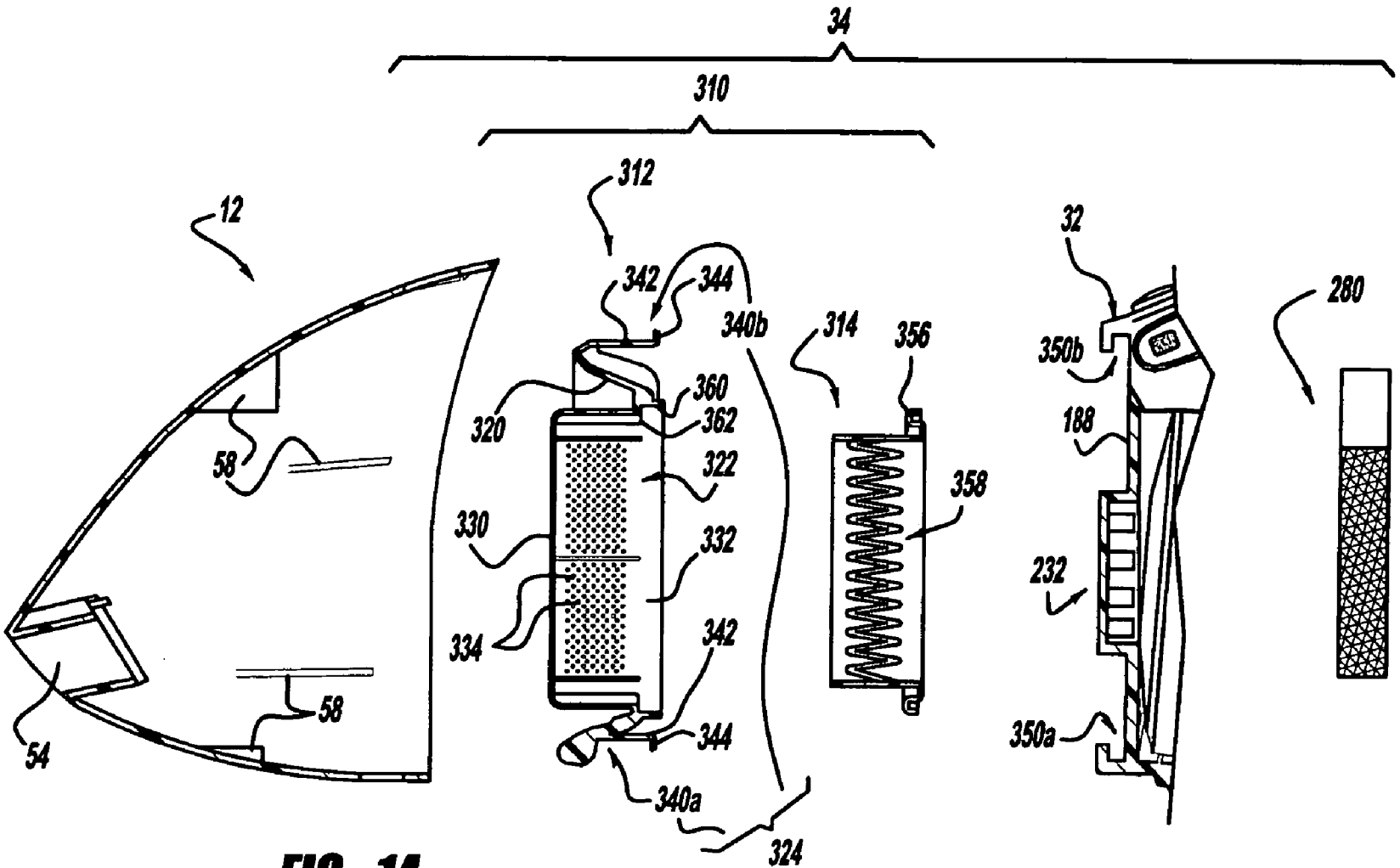
FIG. 14 is an exploded view of a portion of the vacuum of FIG. 2 illustrating the filter system in greater detail.
Figure 15:
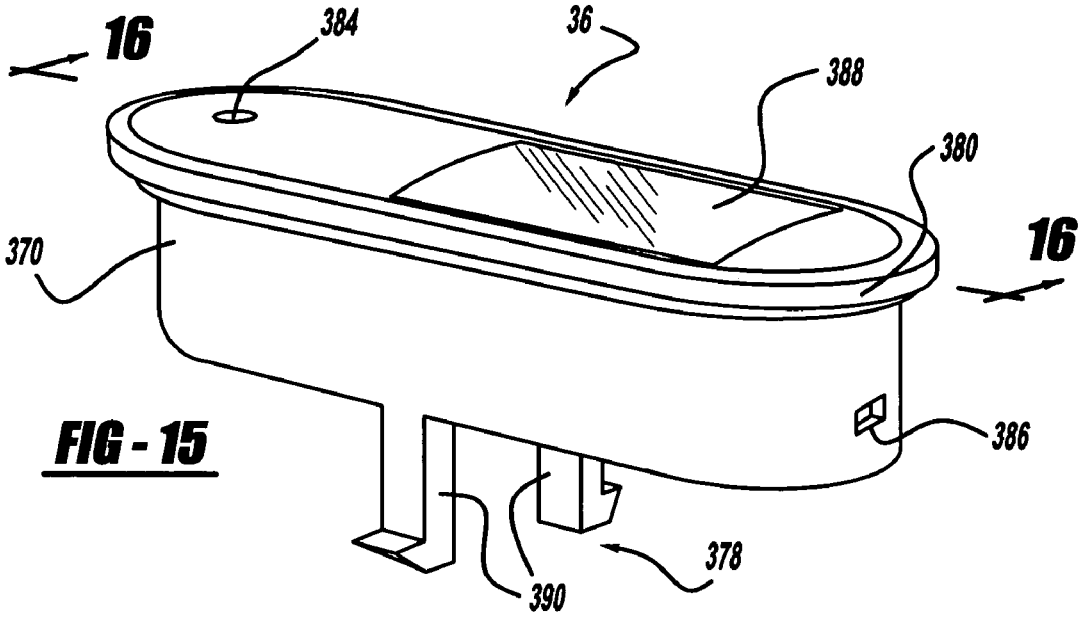
FIG. 15 is a perspective view of a portion of the vacuum of FIG. 2 illustrating the filter indicator in greater detail.

Referring to FIG. 14, the filter system 34 is illustrated to include an intake filter 310 and the above-discussed optional exhaust filter 280. The intake filter 310 includes a prefilter 312 and a primary filter 314. The prefilter 312 includes a filter flange 320, a filter housing 322 and a securing means 324 for releasably securing the prefilter 312 to the housing 32. The filter flange 320 extends outwardly from the filter housing 322 and is configured to sealingly engage the interior of the dirt cup assembly 12. Furthermore, the filter flange 320 abuts or is spaced just rearwardly of the prefilter locating tabs 58 in the vacuum to thereby limit forward movement of the prefilter 312 in the dirt cup assembly 12. The filter flange 320 is illustrated as being unitarily formed with the remainder of the prefilter 312 from a material that is structural yet somewhat flexible, such as polyethylene or polypropylene. Those skilled in the art will appreciate, however, that the filter flange 320 could alternatively include a resilient band of material (not shown) that is coupled to the remainder of the filter flange 320, via a mechanical connection, adhesives or overmolding.

The filter housing 322 is illustrated as being container-like in shape, having a front wall 330 and a pair of side walls 332 that have a plurality of filtering apertures 334 formed therethrough. The filtering apertures 334 are sized to coarsely filter dirt and debris from the air flowing into the primary filter 314. In the example provided, the filtering apertures 334 are about 0.020 inch (0.5 mm) to about 0.040 inch (1.0 mm) in diameter.

In the particular embodiment provided, the securing means 324 is illustrated to include a pair of latch members 340*a* and 340*b*, each having a leg portion 342, which extends rearwardly from the filter flange 320, and a base portion 344 that is coupled to the leg portion 342 and extends generally perpendicularly away from the leg portion 342 in a direction outwardly from the filter housing 322. Each of the latch members 340*a* and 340*b* is configured to engage an associated engagement recess 350*a* and 350*b*, respectively, formed onto the front face of the front wall 188 of the housing 32. More specifically, the latch member 340*a* is initially positioned such that its base portion 344 engages the engagement recess 350*a*, the prefilter 312 is then rotated toward the front wall 188 of the housing 32 while the user of the vacuum exerts downward force on the leg portion 342 of the latch member 340*b* to both maintain the base portion 344 of the latch member 340*a* in the engagement recess 350*a* and deflect the base portion 344 of the latch member 340*b* in a downward direction so that the base portion 344 of the latch member 340*b* may be positioned directly below the engagement recess 350*b*. Thereafter, the latch member 340*b* is released to permit the base portion 344 of the latch member 340*b* to rebound upwardly and engage the engagement recess 350*b* to thereby releasably secure the prefilter 312 to the housing 32.

In the particular example provided, the primary filter 314 includes a perimeter flange 356 and a filter element 358, which is shown as a pleated paper filter element. Those skilled in the art will appreciate, however, that various other filtering media may be used and as such, the particular example provided is not intended to limit the scope of the disclosure in any way. The perimeter flange 356 is configured to sealingly engage the filter housing 322 as well as the front face of the front wall 188 when the prefilter 312 is secured to the housing 32. In the particular embodiment provided, the perimeter flange 356 terminates at its outer edge in a generally S-shaped form that permits it to sealingly engage both the side and rear faces 360 and 362, respectively, of the filter housing 322, as well as the front face of the front wall 188 of the housing 32. The inward portion of the perimeter flange 356 serves as an open-ended container into which the filter element 358 is disposed and coupled. The perimeter flange 356 thus forms a seal about the outer perimeter of the filter element 358 and operably limits forward movement of the filter element 358 toward the front wall 330 of the filter housing 322 as well as rearward movement of the filter element 358 toward the front wall 188 of the housing 32. The lattice structure 232 further supports the primary filter 314 to prevent excessive deflection or collapse of the primary filter 314 during the operation of the vacuum.

With reference to FIGS. 2 and 15 through 17, the filter indicator 36 is generally similar to that which is disclosed in U.S. Pat. No. 4,416,033 entitled "Full Bag Indicator", the disclosure of which is hereby incorporated by reference as if fully set forth herein. Accordingly, a detailed discussion of the filter indicator 36 need not be provided herein. Briefly, the filter indicator 36 is illustrated to include an indicator housing 370, an indicator piston 372, an indicator piston biasing means 374, an indicator gasket 376 and an indicator attachment means 378. The indicator housing 370 defines a flange 380, which extends around the perimeter of the indicator housing 370, a chamber 382, which has an inlet 384 and an outlet 386, and a viewing window 388 that permits the user of the vacuum 10*a* to view a portion of the chamber 382. The indicator piston 372 is slidably disposed in the chamber 382 and biased toward the inlet 384 by the indicator piston biasing means 374, which is illustrated in the particular embodiment provided to be a conventional compression spring. The indicator gasket 376 is abutted against the flange 380 and is preferably formed from a resilient material that may be coated on one or both sides with an adhesive material.

In the example provided, the indicator attachment means 378 includes a pair of conventional bayonets 390 that are integrally formed with a portion of the indicator housing 370. Each of the bayonets 390 includes a leg portion 392, which is fixedly coupled to the indicator housing 370, and an engagement portion 394, which is fixedly coupled to the distal end of the leg portion 392. With additional reference to FIG. 12, the bayonets 390 are sized to fit through corresponding mounting apertures 396 formed through the housing shell 150*a* (the mounting apertures 396 are illustrated as being formed in the indicator recess 300 in the embodiment provided). More specifically, contact between each engagement portion 394 and the housing shell 150*a* in an area proximate the corresponding mounting aperture 396 operably deflects the leg portion 392 in a first direction to permit the bayonet 390 to be fitted through the housing shell 150*a*. Once the engagement portion 394 has cleared the inner side of the housing shell 150*a*, the leg portion 392 moves in a second direction opposite the first direction so that a ledge 398 of the engagement portion 394 engages the inside of the housing shell 150*a* to thereby inhibit the removal of the filter indicator 36 from the housing shell 150*a*. With the filter indicator 36 thus attached to the housing shell 150*a*, the indicator gasket 376 operably seals the joint or interface between the flange of the indicator housing 370 and the housing shell 150*a*.

Figure 16:
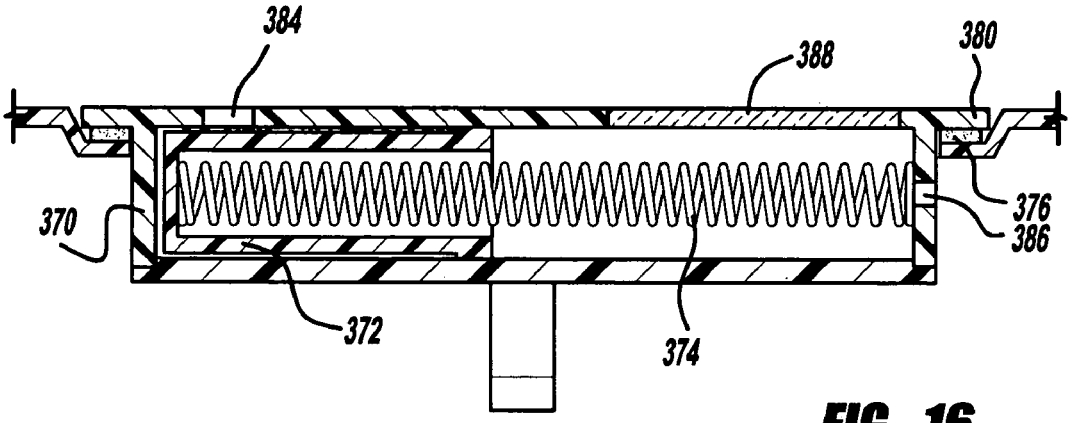
FIG. 16 is a longitudinal section view of the filter indicator.
Figure 17:
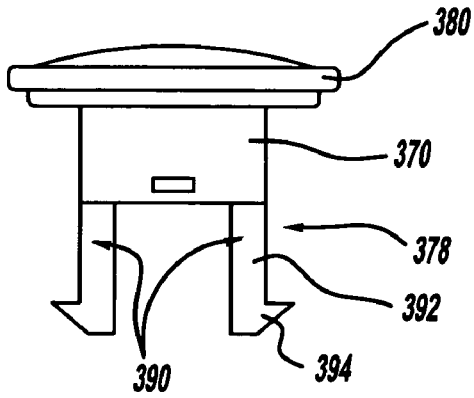
FIG. 17 is a side elevation view of the filter indicator.

With reference to FIGS. 6, 13 and 16, when the vacuum 10*a* is operated, the fan assembly 72 expels air from the fan housing 92 which creates a negative pressure differential relative to atmospheric conditions. The negative pressure differential is communicated through the flow aperture 302 in the indicator housing 370 to the indicator piston 372.

Figure 18:
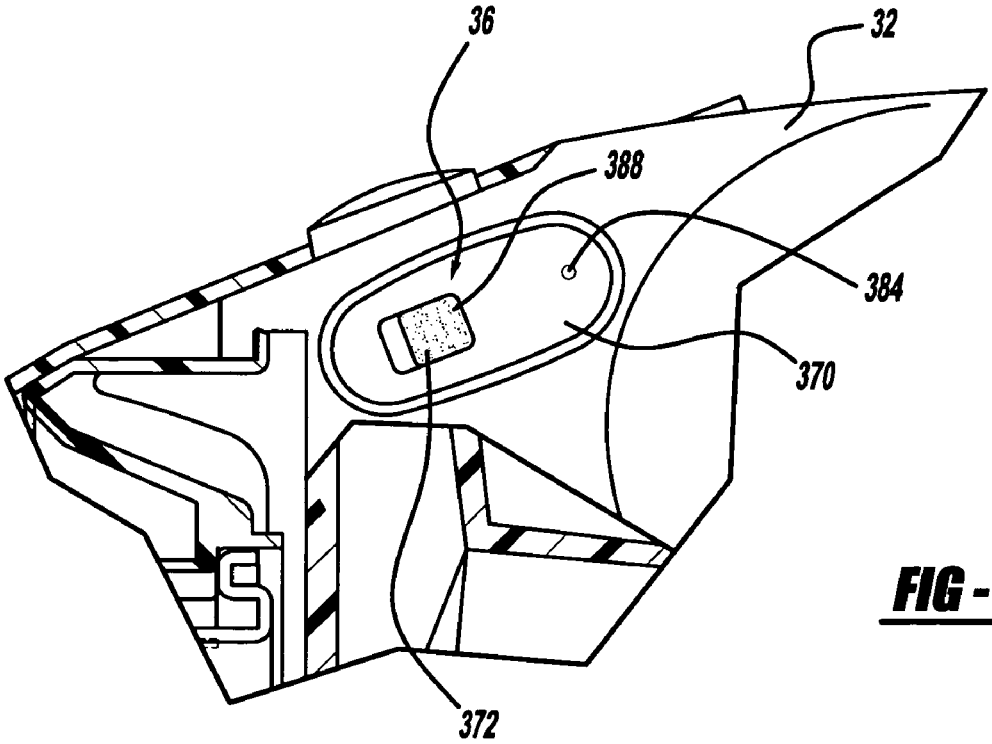
FIG. 18 is a partially broken away side elevation view of the vacuum of FIG. 2 illustrating the filter indicator indicating that the intake filter is in a clogged or dirty condition.

As the pressure of the air in the portion of the central cavity 196 forward of the first fan ribs 200 is relatively lower than atmospheric conditions, atmospheric pressure forces air through the intake filter 310 as well as applies a force to the indicator piston 372 through the inlet 384 of the indicator housing 370. When the intake filter 310 is relatively clean, the negative pressure differential is less than a predetermined threshold and the application of atmospheric pressure on the indicator piston 372 does not cause the indicator piston 372 to slide within the indicator housing 370 into the viewing window 388 beyond a predetermined threshold point. As the intake filter 310 becomes dirty or clogged, however, the flow of air through the intake filter 310 becomes increasingly restricted (relative to a clean filter) so that the negative pressure differential increases in magnitude. At a predetermined point when the intake filter 310 has become sufficiently clogged as illustrated in FIG. 18, the negative pressure differential is sufficiently large in magnitude so that the application of atmospheric pressure on the indicator piston 372 causes the indicator piston to slide within the indicator housing 370 into the viewing window 388 beyond the predetermined threshold point to thereby provide the user of the vacuum 10*a* with a visual indication or alarm that the intake filter 310 has become sufficiently clogged and/or dirty as to require cleaning. Those skilled in the art will appreciate that a porous material (not shown), such as felt, may additionally be placed between the inlet 384 of the indicator housing 370 and the indicator piston 372 to prevent dirt and debris from entering the indicator housing 370 and accumulating thereon or on the indicator piston 372 in a manner that would effect the operation of the filter indicator 36.

Although the filter indicator 36 has been illustrated and described as being completely mechanical and providing only a visual alarm, those skilled in the art will appreciate that the filter indicator 36 may be constructed somewhat differently. For example, various well known devices, such as pressure transducers, may be employed to determine when the pressure of the air between the intake filter 310 and the fan assembly 72 decreases to a predetermined threshold. Furthermore, the filter indicator 36 may be configured so as to additionally or alternatively provide an audible alarm when the pressure of the air between the intake filter 310 and the fan assembly 72 decreases to a predetermined threshold to thereby alert the user of the vacuum 10*a* that the intake filter 310 should be cleaned and/or replaced. Lastly, those of even basic skill in the art will appreciate that the filter indicator 36 may alternatively be constructed to function based on the absolute pressure of the air between the intake filter 310 and the fan assembly 72, rather than on the aforementioned pressure differential with the atmosphere.

Figure 19:
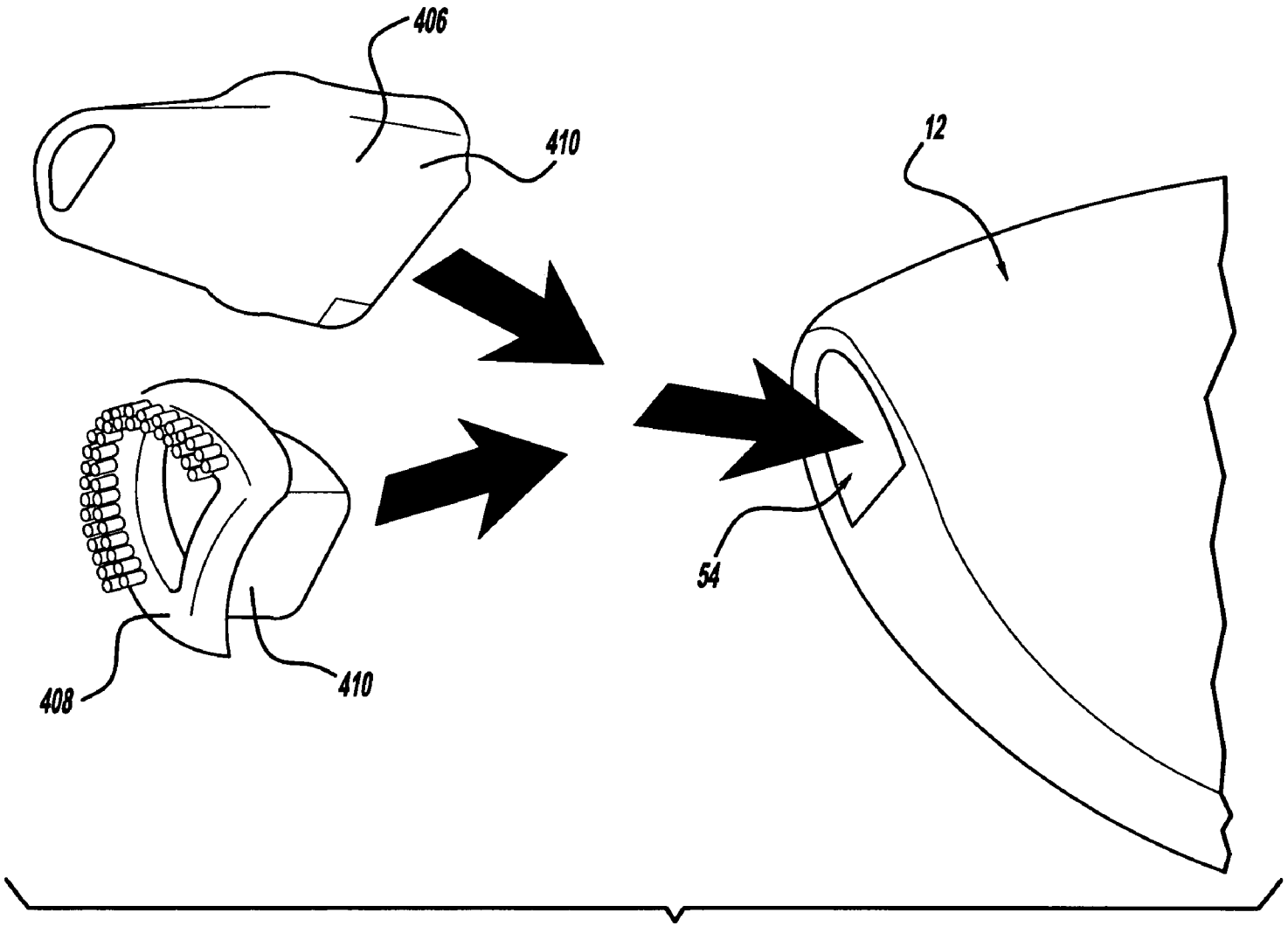
FIG. 19 is an exploded perspective view of a portion of the vacuum kit of FIG. 1 illustrating the connectability of the crevice and brush tools to the dirt cup assembly.

Returning to FIG. 1, the set of accessories 10*b* is illustrated to include a variety of tools, some of which are conventional in their construction and use, and others which are novel. The conventional tools, which include a set of extension tubes 400, a flexible hose 402 and a floor sweeper head 404, are generally well known in the art and as such, a detailed discussion of their construction and use need not be provided herein. The conventional tools also include a crevice tool 406 and a brush tool 408 of the type that are well known in the art but which have a rigid semi-circular stem portion 410 that is configured to frictionally engage the inner surface of the inlet port 54 in the dirt cup assembly 12 as illustrated in FIGS. 19, 19A and 19B.

Returning to FIG. 1, the extension tubes 400 and floor sweeper head 404 utilize a hollow, gently tapered female connector 414 (that is sized, for example, to receive in a conventional friction-fit manner the tapered male connector end 416 of one of the extension tubes 400 or the flexible hose 402). As the inlet port 54 in the dirt cup assembly 12 is generally semi-circular in shape, an inlet port adapter tool 420 is provided. The inlet port adapter tool 420 is formed from a rigid plastic material and includes a first, male end 422 that is sized to engage the inner surface of the inlet port 54 in a friction fit manner, and a second, female end 424 that is sized to engage the male end of the extension tubes 400 or the flexible hose 402 as illustrated in FIGS. 19C and 19D.

Figures 19A, 19B, 19C, 19D, 19E, 19F, 19G:
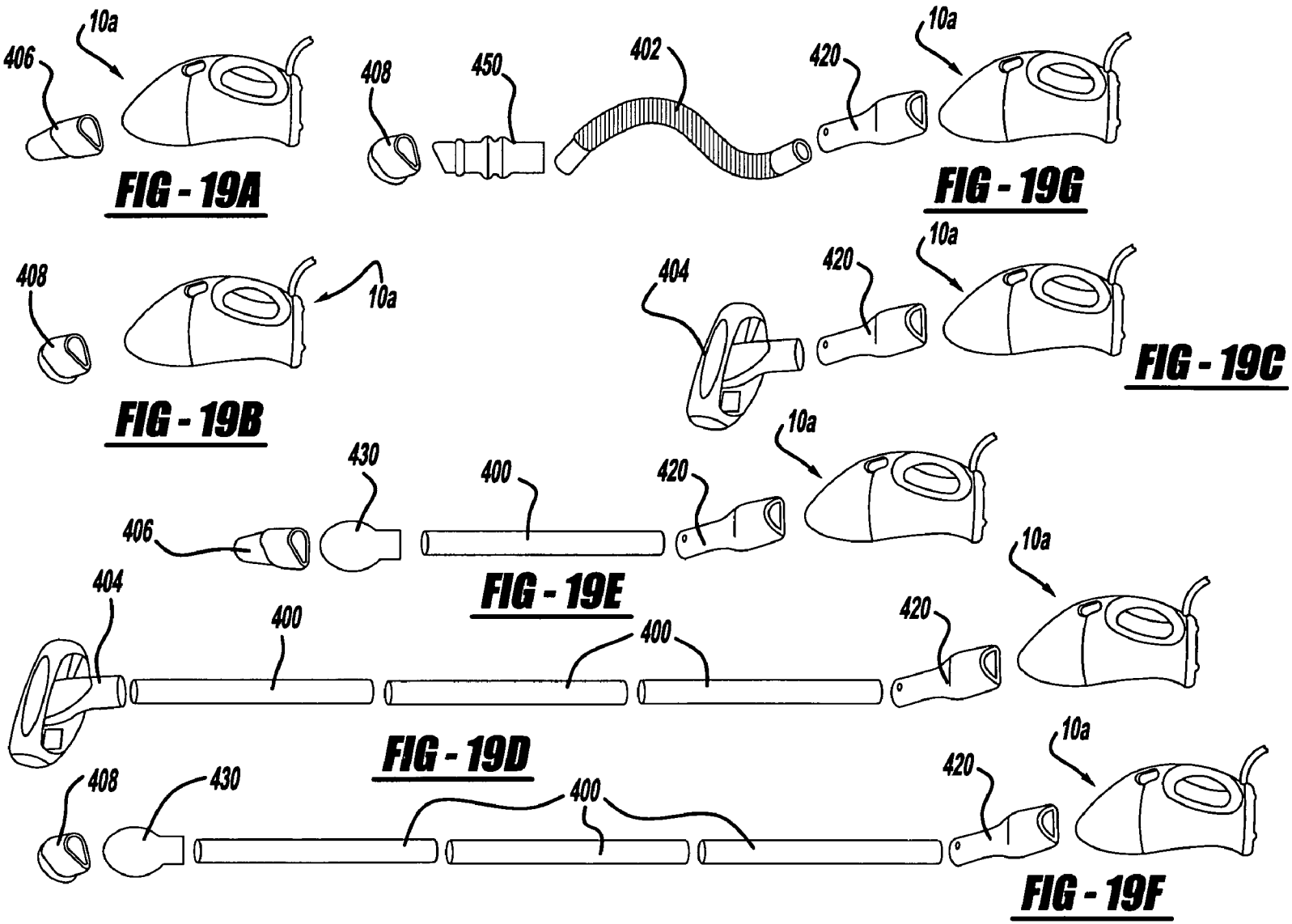
FIG. 19A is an exploded perspective view of the vacuum kit of FIG. 1 illustrating the coupling of the crevice tool directly to the dirt cup assembly.
FIG. 19B is an exploded perspective view of the vacuum kit of FIG. 1 illustrating the coupling of the brush tool directly to the dirt cup assembly.
FIG. 19C is an exploded perspective view of the vacuum kit of FIG. 1 illustrating the coupling of the floor sweeper head to the dirt cup assembly via the inlet port adapter tool.
FIG. 19D is an exploded perspective view of the vacuum kit of FIG. 1 illustrating the coupling of the floor sweeper head to the dirt cup assembly via the inlet port adapter tool and the extension tubes.
FIG. 19E is an exploded perspective view of the vacuum kit of FIG. 1 illustrating the coupling of the crevice tool to the dirt cup assembly via the inlet port adapter tool, an extension tube and the tool adapter.
FIG. 19F is an exploded perspective view of the vacuum kit of FIG. 1 illustrating the coupling of the brush tool to the dirt cup assembly via the inlet port adapter tool, the extension tubes and the tool adapter.
FIG. 19G is an exploded perspective view of the vacuum kit of FIG. 1 illustrating the coupling of the brush tool to the dirt cup assembly via the inlet port adapter tool, the flexible hose and the adapter.

As the stem portion 410 of the crevice tool 406 is generally semi-circular in shape, a tool adapter 430 is provided having a first end that defines a first female connector 432, which is configured to engage the tapered male connector end 416 of the extension tubes 400 and the flexible hose 402 in a friction fit manner, and a second female connector 434, which is configured to engage the rigid semi-circular stem portion 410 of the crevice tool 406 as further illustrated in FIG. 19E. While the brush tool 408 may also be coupled to the tool adapter 430 as illustrated in FIG. 19F, we have found that the connection of the brush tool 408, the tool adapter 430 and the flexible hose 402 to one another is relatively uncomfortable to employ.

Figure 20:
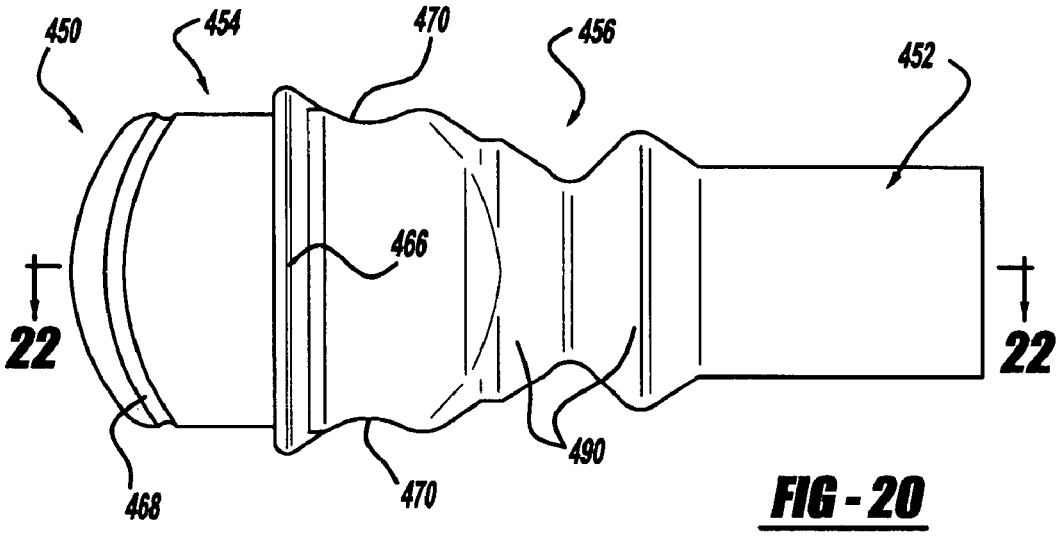
FIG. 20 is a top plan view of a portion of the vacuum kit of FIG. 1 illustrating the adapter in greater detail.
Figure 21:
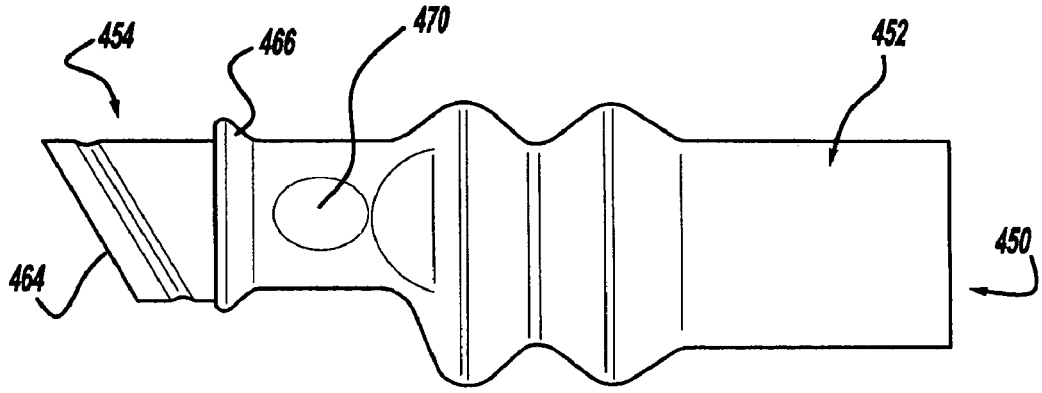
FIG. 21 is a side elevation view of the adapter.
Figure 22:
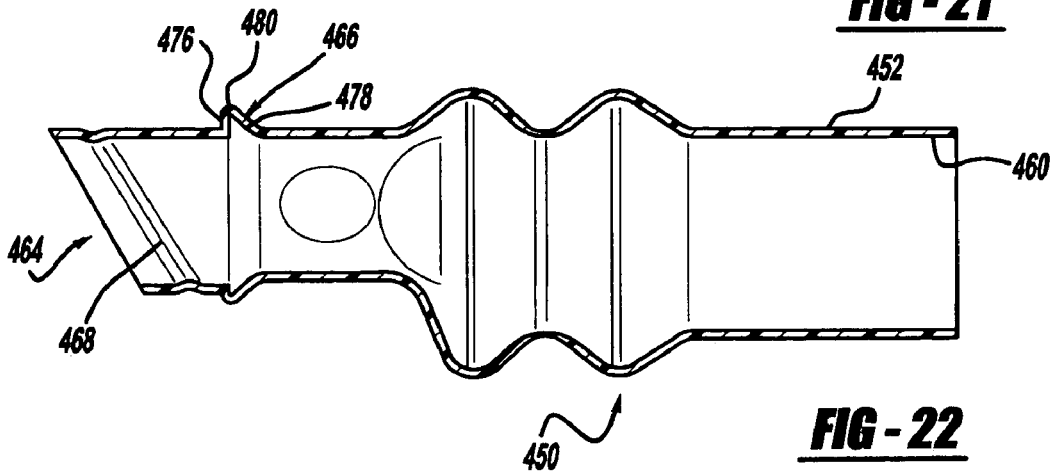
FIG. 22 is a longitudinal section view of the adapter taken along the line 22-22 of FIG. 20.

Accordingly, we have invented an adapter 450 for flexibly coupling the brush tool 408 to the flexible hose 402 as illustrated in FIG. 19G. With specific reference to FIGS. 20 through 22, the adapter 450 is unitarily formed from a resilient material such as polyethylene, and includes a first coupling portion 452, a second coupling portion 454 and a deflectable portion 456. The first coupling portion 452 is tubular in shape, with an inner tapered wall 460 that is configured to sealingly engage the tapered male connector end 416 (FIG. 1) of an extension tube 400 or the flexible hose 402 via a friction fit.

The second coupling portion 454 includes a semi-circular opening 464, which is sized to receive and sealingly engage the stem portion 410 of the brush tool 408 (FIG. 1) via a friction fit, an outer sealing ridge 466, which extends around the outer perimeter of the second coupling portion 454, and an inner sealing ridge 468, which extends around the inner perimeter of the second coupling portion 454. The outer sealing ridge 466 includes a generally vertical abutting wall 476, a rearwardly tapering wall 478 and a rounded crest 480 that couples the abutting wall 476 to the tapering wall 478. The outer sealing ridge 466 will be discussed in further detail, below.

The inner sealing ridge 468 is formed with a rounded profile that permits the second coupling portion 454 to engage the stem portion 410 (FIG. 1) of the brush tool 408 in a line-to-line manner around the perimeter of the stem portion 410 for improved sealing and easier insertion of the stem portion 410 to the second coupling portion 454.

The deflectable portion 456 interconnects the first and second coupling portions 452 and 454 and includes a plurality of convolutions 490 and a pair of optional detents 470, which are located between the outer sealing ridge 466 and the convolutions 490. The convolutions 490 permit the first and second coupling portions 452 and 454 to be deformed or flexed relative to one another in a predictable manner. The characteristics of the material from which the adapter 450 is formed and the geometry of the convolutions 490 (including wall thicknesses) provide the deflectable portion 456 with a degree of rigidity so that it does not deflect excessively under normal use but which permits the deflectable portion 456 to bend and yield (as required) in the event that stress levels beyond a predetermined threshold are applied to the first and second coupling portions 452 and 454. As those skilled in the art will appreciate, the deflectable portion 456 may bend or flex such that the convolutions 490 flex or bend about the longitudinal axis of the adapter 450 and/or contract along the longitudinal axis of the adapter 450. Preferably, the material characteristics and the geometry of the convolutions 490 permit the deflectable portion 456 to return to (or close to) its original shape and configuration once such stress levels are removed. The convolutions have been designed both in number and ratio of large to small diameter, along with wall thickness, to allow for no permanent deformation during normal use with extension tubes including some side force from pushing against a typical household object such as furniture. The characteristic of permanent deformation/bending in the area of convolutions may be a level that is below the force required to break the housings if the unit were dropped or the vacuum with adaptor and extension tubes were used to excessively push or pry an object, with a safety factor considered. The detents 470 are located on the opposite lateral sides of the second coupling portion 454 and are configured to be engaged by the thumb and index finger of the user of the vacuum 10*a*.

Figure 24:
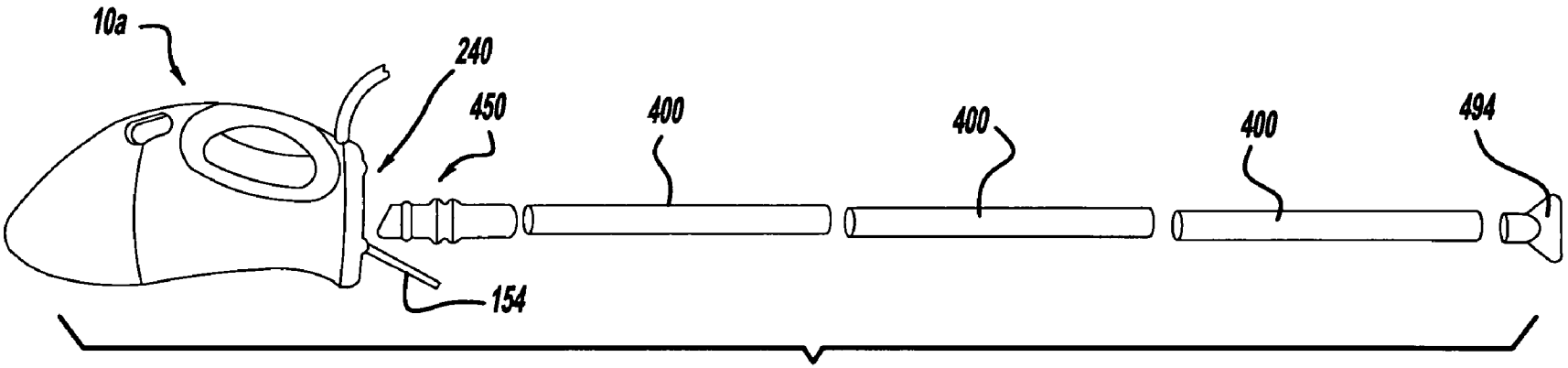
FIG. 24 is an exploded perspective view illustrating the vacuum kit of FIG. 1 as employed in a blower mode.

The adapter 450 is additionally useful when it is desired to employ the exhaust of the vacuum 10*a* for tasks such as blowing or inflating as is illustrated in FIGS. 23 and 24. In this mode, the rear deflector 154 is positioned in the open position to expose the outlet port 240. The second coupling portion 454 is then inserted into the outlet port 240 such that the vertical abutting wall 476 abuts the rear wall 194 of the housing 32. Frictional engagement between the second coupling portion 454, the outlet port 240 and the gusset 242 is sufficient to maintain the adapter 450 engaged to the vacuum 10*a* in most conditions, even where relatively heavy components, such as the extension tubes 400 and a blower diffuser tool 494, are collectively coupled to one another as illustrated in FIG. 23.

Figure 25:
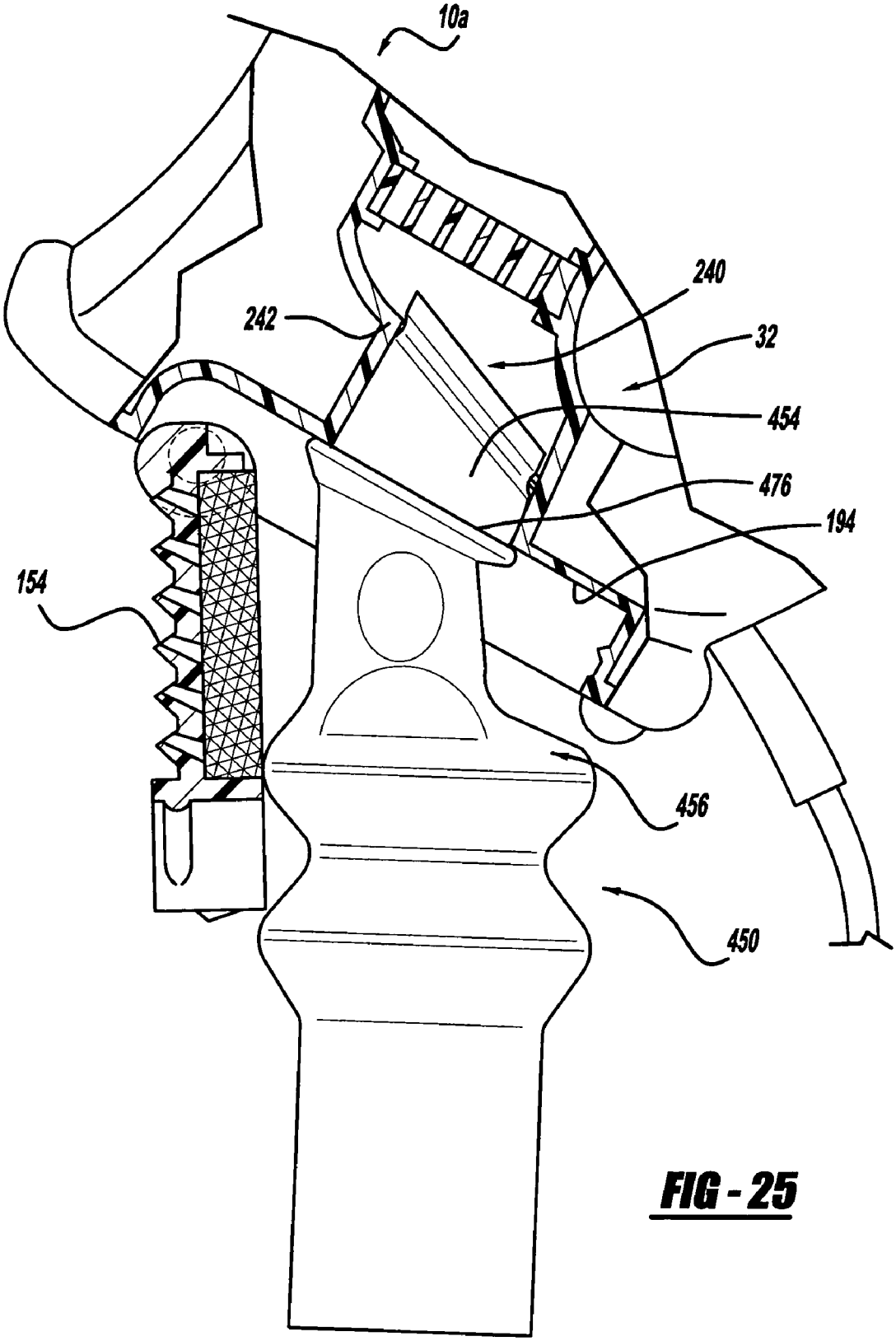
FIG. 25 is a partially sectioned side view of a portion of the vacuum kit of FIG. 1 illustrating the adapter deflecting in response to closing of the rear deflector against the adapter.

The adapter's 450 capability of being deformed advantageously guards against damage to the vacuum 10*a* should the user drop or impact the vacuum 10*a*. For example, if the vacuum 10*a* were to be used in the blower mode and dropped so that the rear deflector 154 pivoted toward the closed position and impacted the adapter 450 as illustrated in FIG. 25, the adapter 450 is capable of deflecting to thereby prevent damage to (or at least reduce the extent of such damage) to the rear deflector 154 and the housing shells 150*a* and 150*b*.

Figure 26:
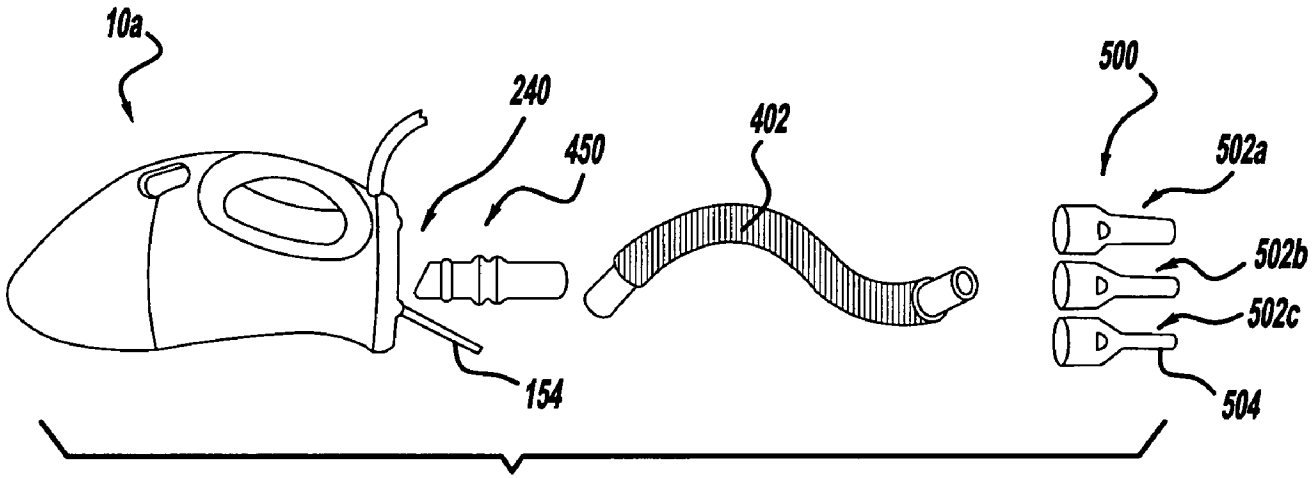
FIG. 26 is an exploded perspective view illustrating the vacuum kit of FIG. 1 as employed in an inflator mode.
Figure 27:
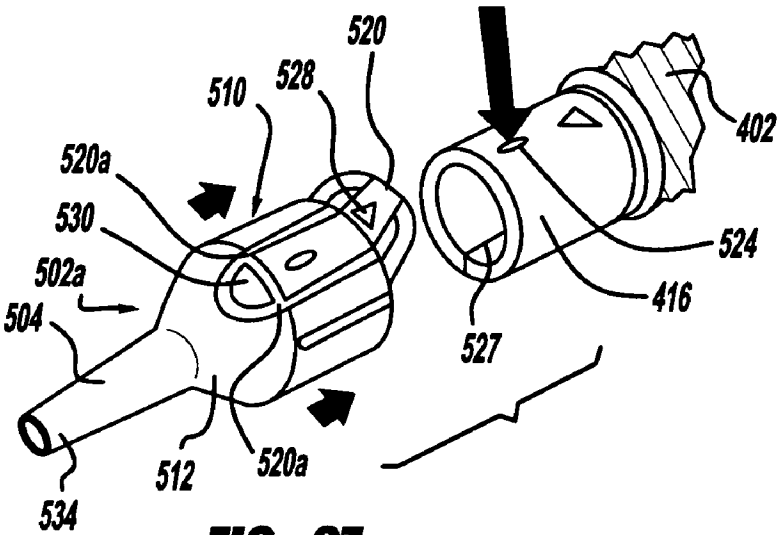
FIG. 27 is an exploded perspective view of a portion of the vacuum kit of FIG. 1 illustrating the inflator nozzle in greater detail.

As noted above, the vacuum 10*a* may also be used in the blower mode to inflate inflatable articles. To aid in this task, the accessory set 10*b* further includes a set of inflator nozzles 500 having nozzles 502*a*, 502*b* and 502*c* as illustrated in FIGS. 1, 26 and 27. The nozzles 502*a*, 502*b* and 502*c* are illustrated as being generally identical to one another except for the relative size (e.g., outer diameter) of their outlet 504. As such, a description of nozzle 502*a* will suffice for all three.

Figure 28:
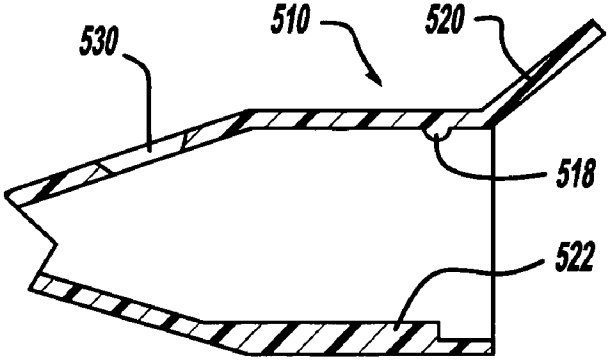
FIG. 28 is a partial longitudinal section view of the inflator nozzle.

In FIGS. 27 and 28, the nozzle 502*a* is illustrated as being unitarily formed from a plastic material such as polypropylene. In addition to the outlet 504, the nozzle 502*a* includes a tapered female coupling portion 510 and a hollow body portion 512. The tapered female coupling portion 510 is generally similar to the tapered female connector 414 of the extension tubes 400, except for the inclusion of a coupling prong 518, an uncoupling tab 520 and a key 522. The coupling prong 518 is a protrusion that extends inwardly from the interior surface of the tapered female coupling portion 510 and which is configured to engage a hole or a depression 524 that is formed on the exterior of the tapered male connector end 416 of the flexible hose 402. In the particular embodiment provided, the depression 524 is integrally formed with the remainder of the tapered male connector end 416, as is a first alignment feature 526, which is illustrated to be an arrow in the particular embodiment provided. Furthermore, a keyway 527 is formed into the tapered male connector end 416 of the flexible hose 402 which is sized to receive the key 522. In the particular example provided, the key 522 is a flat beam-like protrusion and the keyway 527 is a slot that is formed in the tapered male connector end 416.

The uncoupling tab 520 is a flap-like member that extends rearwardly from the remainder of the tapered female coupling portion 510 and is coupled to the remainder of the tapered female coupling portion 510 via a pair of living hinges 520*a*. The uncoupling tab 520 is configured to be gripped between the thumb and index finger of the user of the vacuum 10*a* when the inflator nozzle 502*a* is to be uncoupled from the flexible hose 402. One or more link members 520*b* may be employed to couple an end of the uncoupling tab 520 to the tapered female coupling portion 510. The link members 520*b*, which may be arcuately shaped, may be configured to limit an amount by which the uncoupling tab 520 is pivoted about the living hinges 520*a*. A second alignment feature 528, which is illustrated to be an arrow in the particular embodiment provided, is integrally formed with the uncoupling tab 520.

In the particular embodiment illustrated, the body portion 512 tapers gently between a first end, which is coupled to the tapered female coupling portion 510, and a second end, which is coupled to the outlet 504. The body portion 512 includes a relief aperture 530 that extends completely through the body portion 512. The outlet 504 is illustrated as being a gently tapered hollow frustum with a tip portion 534 that is sized to be received into the valve or orifice of an inflatable object.

To install the nozzle 502*a* to the flexible hose 402, the tapered male connector end 416 of the flexible hose 402 is initially inserted (but not fully inserted) into the tapered female coupling portion 510 of the nozzle 502*a*. The nozzle 502*a* and the tapered male connector end 416 are rotated relative to one another as necessary to align the key 522 and the keyway 527 and the tapered male connector end 416 is thereafter fully inserted into the tapered female coupling portion 510 of the nozzle 502*a*. Alignment of the first and second alignment features 526 and 528 to one another ensures that the coupling prong 518 will extend into the depression 524 on the tapered male connector end 416 to thereby inhibit the nozzle 502*a* from disengaging the flexible hose 402 during the operation of the vacuum 10*a*.

Figure 29:
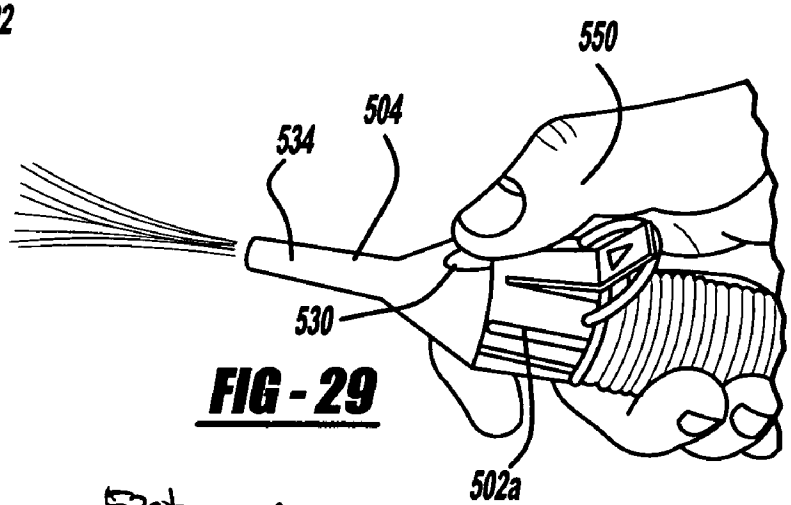
FIG. 29 is a perspective view of a portion of the vacuum kit of FIG. 1 illustrating the operation of the inflator nozzle.

Exhaust from the vacuum 10*a* is ordinarily able to exit both the relief aperture 530 and the outlet 504 of the nozzle 502*a*. The relief aperture 530 is preferably larger in size than the outlet 504 of the nozzle 502*a* to permit the user to better control the rate with which an object may be inflated as will be described in greater detail, below. In the particular example provided, the relief aperture 530 is generally triangular in shape, having an area of approximately 0.09 square inch while the size of the outlet 504 is about 0.27 inch in diameter and having an area of about 0.057 square inch. With the tip portion 534 of the outlet 504 inserted into the valve, the user may selectively close of all or a portion of the relief aperture 530 with their thumb 550 or index finger to control the rate with which an object is inflated as illustrated in FIG. 29. Furthermore, once an object has been inflated, the user can release their thumb 550 or index finger from the relief aperture 530 so that the exhaust of the vacuum is discharged wholly or at least in substantial part from the relief aperture 530 to thereby guard against over-inflation of the inflatable object.

Figure 30:
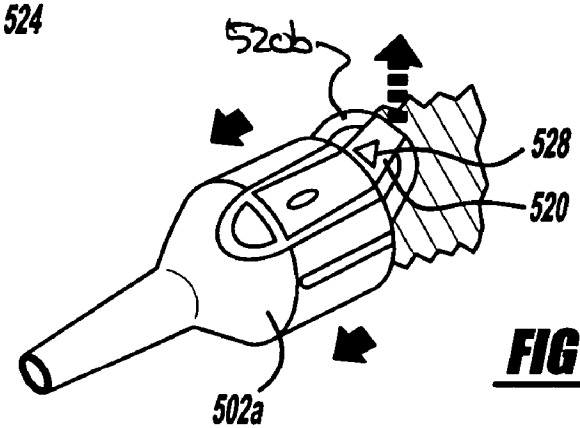
FIG. 30 is a perspective view illustrating the uncoupling of the inflator nozzle from the flexible hose.

To remove the nozzle 502*a* from the flexible hose 402, the uncoupling tab 520 is lifted as shown in FIG. 30 to disengage the coupling prong 518 from the depression 524 and thereafter the nozzle 502*a* is slidingly removed from the tapered male connector end 416 of the flexible hose 402. From the foregoing, those skilled in the art will readily appreciate that the coupling prong 518 may alternatively be formed on or otherwise attached to the tapered male connector end 416 of the flexible hose 402 and that the depression 524 may be formed or otherwise into the nozzle 502*a*.

With reference to FIGS. 31 and 32, the housing 32 is illustrated to include a tool storage cavity 600 for storing the brush tool 408 and the crevice tool 406. The cavity 600 includes a brush tool aperture 602, a crevice tool aperture 604, a plurality of engagement ribs 606 and a pair of securing legs 608. The brush tool aperture 602 is formed into the arcuately shaped bottom wall 192 and sized to receive the brush tool 408. The engagement ribs 606 are disposed within the brush tool aperture 602 and extend generally outwardly therefrom. The engagement ribs 606 are configured to engage the sides of the stem portion 410 of the brush tool 408 in a snap-fit manner to thereby releasably secure the brush tool 408 within the brush tool aperture 602.

The crevice tool aperture 604 is sized to receive the crevice tool 406, while the securing legs 608 are sized to engage the outer perimeter of the stem portion 410 of the crevice tool 406. In this regard, the securing legs 608 essentially mimic a portion of the inlet port 54 (FIG. 19) so that the stem portion 410 of the crevice tool 406 frictionally engages the securing legs 608 when the crevice tool 406 is inserted therebetween. Additionally, the nose 406*a* of the crevice tool 406 is sized to engage the interior of the stem portion 410 of the brush tool 408 when the brush tool 408 is secured in the brush tool aperture 602. Engagement of the crevice tool 406 to the brush tool 408 further resists undesired uncoupling of these tools from the housing 32.

With the crevice tool 406 and the brush tool 408 stored in the housing 32, the housing 32 may be overturned and rested on the bottom wall 192. As the bottom wall 192 is arcuately shaped, the brush tool 408 and the crevice tool 406 are positioned so as not to affect the point at which the vacuum 10*a* contacts a flat surface, such as a floor. In this regard, the vacuum 10*a* is configured so that the securing legs 608 and the portion of the bottom wall 192 forwardly of the tool storage cavity 600 support the vacuum 10*a*. Additionally, the design of the rear surface of the vacuum includes offset projections that allow it to rested on the rear surface with three points touching for stability while the cord is wrapped around the main housing body and secured with the cord retaining clip molded into the plug end of the cord.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A portable vacuum comprising:

an inlet housing defining an inlet that is configured to receive dirt, dust and debris therethrough;

an outlet housing releasably coupled to the inlet housing, the outlet housing defining a handle, an intake, and an exhaust outlet;

a fan assembly mounted in the outlet housing, the fan being operable for generating an air flow that is exhausted through the exhaust outlet;

a hose having a first end, which may be selectively coupled to the exhaust outlet, and a second end; and a set of inflator nozzles, each of the inflator nozzles including a coupling portion, which is configured to selectively engage the second end of the hose, a tapered male connector that defines an outlet aperture, a hollow body portion, which is disposed between the coupling portion and the tapered male connector, and a relief aperture that extends through a wall of the inflator nozzle into a generally hollow interior;

wherein the tapered male connector of each inflator nozzle is differently sized; and wherein the relief aperture is formed on a forward face of the hollow body portion, the forward face being oriented relative to the coupling portion such that when the relief aperture is closed by a thumb of a person using the portable vacuum, at least a portion of a force exerted by the thumb to close the relief aperture at least partially urges the inflator nozzle in a direction toward the second end of the hose.

2. The portable vacuum of claim 1, wherein the relief aperture is generally triangular in shape.

3. The portable vacuum of claim 1, wherein an area of the relief aperture is about twice as large as an area of the outlet aperture in at least one of the inflator nozzles.

4. The portable vacuum of claim 1, wherein an area of the relief aperture is about 0.09 square inches.

5. The portable vacuum of claim 1, wherein the set of inflator nozzles includes at least three inflator nozzles.

6. A portable vacuum comprising:

an inlet housing defining an inlet that is configured to receive dirt, dust and debris therethrough;

an outlet housing releasably coupled to the inlet housing, the outlet housing defining a handle, an intake, and an exhaust outlet;

a fan assembly mounted in the outlet housing, the fan being operable for generating an air flow that is exhausted through the exhaust outlet;

a hose having a first end, which may be selectively coupled to the exhaust outlet, and a second end;

a set of inflator nozzles, each of the inflator nozzles including a coupling portion, which is configured to selectively engage the second end of the hose, a tapered male connector that defines an outlet aperture, and a relief aperture that extends through a wall of the inflator nozzle into a generally hollow interior; and a latch for releasably securing the second end of the hose and the coupling portion to one another;

wherein the tapered male connector of each inflator nozzle is differently sized.

7. The portable vacuum of claim 6, wherein the latch includes a recess that is formed into one of the coupling portion and the second end of hose, and an engagement member that is associated with the other one of the coupling portion and the second end of the hose, wherein placement of the engagement member in the recess latches one of the inflator nozzles to the second end of the hose.

8. The portable vacuum of claim 7, wherein a keyway is formed in one of the coupling portion and the second end of the hose and a mating key is associated with the other one of the coupling portion and the second end of the hose, and wherein placement of the key in the keyway aligns the engagement member and the recess to one another.

9. The portable vacuum of claim 7, wherein each of the inflator nozzles further includes a tab that is adapted to be grasped by a user of the portable vacuum to lift the engagement member out of the recess.

10. The portable vacuum of claim 9, wherein the tab is axially in line with the relief aperture.

11. The portable vacuum of claim 9, wherein the tab is coupled to the coupling portion by at least one living hinge.

12. The portable vacuum of claim 11, wherein the living hinges are located adjacent the relief aperture.

13. The portable vacuum of claim 10, wherein at least one link member couples an end of the tab opposite the living hinges to the coupling portion, the at least one link member being operable for limiting an amount by which the tab may be pivoted about the living hinges.

14. A hand-held portable vacuum comprising:

an inlet housing defining an inlet that is configured to receive dirt, dust and debris therethrough;

an outlet housing releasably coupled to the inlet housing, the outlet housing defining a handle, an intake, a fan mount and an outlet, the handle being configured to be grasped by a single hand of a user to permit the user to maneuver the hand-held portable vacuum and orient the inlet into a desired position, the fan mount being disposed between the intake and the outlet;

a fan assembly mounted in the fan mount and housed by the outlet housing, the fan assembly having a fan inlet and being operable for generating an air flow therethrough;

a filter disposed between the inlet and the intake and being releasably coupled to one of the inlet housing and the outlet housing;

a filter indicator coupled to the outlet housing and being in fluid communication with a portion of the outlet housing between the fan inlet and the intake, the filter indicator including a pressure differential indicator that is configured to indicate a pressure differential between air in the portion of the outlet housing and atmospheric air pressure;

a hose having a first end, which may be selectively coupled to the exhaust outlet, and a second end; and a set of inflator nozzles, each of the inflator nozzles including a coupling portion, which is configured to selectively engage the second end of the hose, a tapered male connector that defines an outlet aperture, a hollow body portion, which is disposed between the coupling portion and the tapered male connector, and a relief aperture that extends through a wall of the inflator nozzle into a generally hollow interior;

wherein the tapered male connector of each inflator nozzle is differently sized; and wherein the relief aperture is formed on a forward face of the hollow body portion, the forward face being oriented relative to the coupling portion such that when the relief aperture is closed by a thumb of a person using the portable vacuum, at least a portion of a force exerted by the thumb to close the relief aperture at least partially urges the inflator nozzle in a direction toward the second end of the hose.

* * * * *